US009881719B2

(12) United States Patent
Harada et al.

(10) Patent No.: US 9,881,719 B2
(45) Date of Patent: Jan. 30, 2018

(54) CHIP RESISTOR AND METHOD FOR MAKING THE SAME

(71) Applicant: ROHM CO., LTD., Kyoto-shi, Kyoto (JP)

(72) Inventors: Kenichi Harada, Kyoto (JP); Masaki Yoneda, Kyoto (JP)

(73) Assignee: ROHM CO., LTD., Kyoto (JP)

( * ) Notice: Subject to any disclaimer, the term of this patent is extended or adjusted under 35 U.S.C. 154(b) by 0 days.

(21) Appl. No.: 15/629,400

(22) Filed: Jun. 21, 2017

(65) Prior Publication Data

US 2017/0287602 A1 Oct. 5, 2017

Related U.S. Application Data

(63) Continuation of application No. 14/886,943, filed on Oct. 19, 2015, now Pat. No. 9,711,265, which is a (Continued)

(30) Foreign Application Priority Data

Feb. 21, 2013 (JP) ..... 2013-032158

(51) Int. Cl.
*H01C 1/14* (2006.01)
*H01C 17/00* (2006.01)
(Continued)

(52) U.S. Cl.
CPC ..... *H01C 1/14* (2013.01); *H01C 17/006* (2013.01); *H01C 17/06* (2013.01); *H01C 17/283* (2013.01); *Y10T 29/49082* (2015.01)

(58) Field of Classification Search
CPC ..... H01C 1/14; H01C 1/148; H01C 17/006; H01C 17/283
(Continued)

(56) References Cited

U.S. PATENT DOCUMENTS 7,129,814 B2 10/2006 Tsukada
8,044,765 B2 10/2011 Tsukada
(Continued)

FOREIGN PATENT DOCUMENTS

JP 3-165501 A 7/1991
JP 7-192902 A 7/1995
(Continued)

OTHER PUBLICATIONS

Office Action issued in corresponding Japanese Patent Application, dated Nov. 15, 2016, and corresponding English machine translation.

*Primary Examiner* — Kyung Lee
(74) *Attorney, Agent, or Firm* — Hamre, Schumann, Mueller & Larson, P.C.

(57) ABSTRACT

A chip resistor includes first and second electrodes spaced apart from each other, a resistor element arranged on the first and the second electrodes, a bonding layer provided between the resistor element and the two electrodes, and a plating layer electrically connected to the resistor element. The first electrode includes a flat outer side surface, and the resistor element includes a side surface facing in the direction in which the thirst and the second electrodes are spaced. The outer side surface of the first electrode is flush with the side surface of the resistor element. The plating layer covers at least a part of the outer side surface of the first electrode in a manner such that the covering portion of the plating layer extends from one vertical edge of the outer side surface to the other vertical edge.

13 Claims, 25 Drawing Sheets

Related U.S. Application Data continuation of application No. 14/184,113, filed on Feb. 19, 2014, now Pat. No. 9,177,701.

(51) Int. Cl.
*H01C 17/06* (2006.01)
*H01C 17/28* (2006.01)

(58) Field of Classification Search
USPC ..... 338/328, 323, 313, 314
See application file for complete search history.

(56) References Cited

U.S. PATENT DOCUMENTS

| | | | |
|---|---|---|---|
| 2004/0041278 | A1 | 3/2004 | Akhtman et al. |
| 2009/0217511 | A1 | 9/2009 | Chen et al. |
| 2011/0057766 | A1 | 3/2011 | Chen et al. |

FOREIGN PATENT DOCUMENTS

| | | | |
|---|---|---|---|
| JP | 10-050502 | A | 2/1998 |
| JP | 2002-313612 | A | 10/2002 |
| JP | 2003-197404 | A | 7/2003 |
| JP | 2009-218552 | A | 9/2009 |

CHIP RESISTOR AND METHOD FOR MAKING THE SAME

BACKGROUND OF THE INVENTION

1. Field of the Invention

The present invention relates to a chip resistor and a method for making a chip resistor.

2. Description of the Related Art

Conventionally, chip resistors for use in electronic equipment are known. For instance, the chip resistor disclosed in JP-A-2009-218552 includes a resistor element made of metal and two electrodes. The two electrodes are provided on the resistor element as spaced apart from each other. To keep the strength of the chip resistor, the thickness of the resistor element as itself, which is made of metal, cannot be considerably reduced. Thus, in the conventional chip resistor, the resistance cannot be made sufficiently high.

SUMMARY OF THE INVENTION

The present invention has been conceived under the circumstances described above. It is therefore an object of the present invention to provide a chip resistor that can have increased resistance while keeping the strength.

According to a first aspect of the present invention, there is provided a chip resistor that includes: a first electrode and a second electrode spaced apart from each other, the first electrode being offset from the second electrode in a first direction, the second electrode being offset from the first electrode in a second direction opposite from a first direction; a resistor element arranged on the first electrode and the second electrode; a bonding layer provided between the first electrode and the resistor element and between the second electrode and the resistor element; and a first plating layer electrically connected to the resistor element. The first electrode includes a flat first-electrode outer side surface. The resistor element includes a first resistor-element side surface facing in the first direction. The first-electrode outer side surface is flush with the first resistor-element side surface. The first-electrode outer side surface includes two edges spaced apart from each other in a third direction perpendicular to both the first direction and a thickness direction of the first electrode. The first plating layer includes a portion directly covering at least a part of the first-electrode outer side surface, where the above-mentioned portion of the first plating layer extends continuously from one of the two edges to the other of the two edges.

Preferably, the first electrode includes a first-electrode obverse surface on which the resistor element is arranged and a first-electrode reverse surface facing away from the first-electrode obverse surface. The first plating layer directly covers the first-electrode reverse surface.

Preferably, the first electrode includes two first-electrode end surfaces facing away from each other, where one of the two first-electrode end surfaces faces in the third direction, and the first plating layer directly covers the two first-electrode end surfaces.

Preferably, the first electrode includes a first-electrode inner side surface facing toward the second electrode, and the first plating layer directly covers the first-electrode inner side surface.

Preferably, the first electrode includes an end that is disposed on a side of the first direction and formed with a sharp portion pointed in the first direction.

Preferably, the sharp portion of the first electrode is provided at the first-electrode obverse surface, and the first electrode includes a first curved surface connecting the first-electrode reverse surface and the first-electrode outer side surface to each other.

Preferably, the resistor element includes a serpentine portion.

Preferably, the bonding layer includes a bonding layer obverse surface held in direct contact with the resistor element.

Preferably, the first plating layer includes an inner plating film and an outer plating film, where the inner plating film directly covers the first electrode.

Preferably, the first plating layer includes an intermediate plating film disposed between the inner plating film and the outer plating film.

Preferably, the inner plating film is made of one of Cu, Ag and Au, the outer plating film is made of Sn, and the intermediate plating film is made of Ni.

Preferably, the chip resistor according to the first aspect of the present invention further includes a second plating layer electrically connected to the resistor element. The second electrode includes a flat second-electrode outer side surface, the resistor element includes a second resistor-element side surface facing in the second direction, and the second-electrode outer side surface is flush with the second resistor-element side surface. The second-electrode outer side surface includes two edges spaced apart from each other in the third direction. The second plating layer includes a portion directly covering at least a part of the second-electrode outer side surface, where the above-mentioned portion of the second plating layer extends continuously from one of the two edges of the second-electrode outer side surface to the other of the two edges of the second-electrode outer side surface.

Preferably, the second electrode includes a second-electrode obverse surface on which the resistor element is arranged and a second-electrode reverse surface facing away from the second-electrode obverse surface, where the second plating layer directly covers the second-electrode reverse surface.

Preferably, the second electrode includes two second-electrode end surfaces facing away from each other, where one of the two second-electrode end surfaces faces in the third direction, and the second plating layer directly covers the two second-electrode end surfaces.

Preferably, the second electrode includes a second-electrode inner side surface facing toward the first electrode, and the second plating layer directly covers the second-electrode inner side surface.

Preferably, the second electrode includes an end that is disposed on a side of the second direction and formed with a sharp portion pointed in the thickness direction.

Preferably, the sharp portion of the second electrode is provided at the second-electrode obverse surface, and the second electrode includes a second curved surface connecting the second-electrode reverse surface and the second-electrode outer side surface to each other.

Preferably, the chip resistor of the first aspect further includes an insulating protective film covering the resistor element, where the protective film is held in direct contact with the first plating layer.

Preferably, the chip resistor of the first aspect further includes an insulating heat conductive portion provided between the first electrode and the second electrode.

Preferably, the heat conductive portion is held in direct contact with the bonding layer.

Preferably, the first electrode and the second electrode are made of one of Cu, Ag, Au and Al.

Preferably, the bonding layer is made of an epoxy-based material.

Preferably, the resistor element is made of one of manganin, zeranin, Ni—Cr alloy, Cu—Ni alloy and Fe—Cr alloy.

According to a second aspect of the present invention, there is provided a method for making a chip resistor of the first aspect, where the method includes the steps of: preparing an electrically conductive base; and bonding a resistor element material to an obverse surface of the electrically conductive base by a bonding material.

Preferably, the base is formed with a plurality of grooves elongated in a direction.

Preferably, the bonding material is an adhesive sheet or a liquid adhesive.

Preferably, the method of the second aspect further includes the step of forming an insulating protective film covering the resistor element material.

Preferably, the method of the second aspect further includes the step of providing a heat conductive portion in each of the grooves after the step of bonding the resistor element material.

Preferably, the method of the second aspect further includes the step of obtaining a plurality of individual pieces by cutting the base.

Preferably, the step of obtaining a plurality of individual pieces includes cutting the base by punching or dicing.

Preferably, the method of the second aspect further includes the step of forming a plating layer on each of the individual pieces.

Other features and advantages of the present invention will become more apparent from detailed description given below with reference to the accompanying drawings.

DESCRIPTION OF THE PREFERRED EMBODIMENTS

Figure 1:
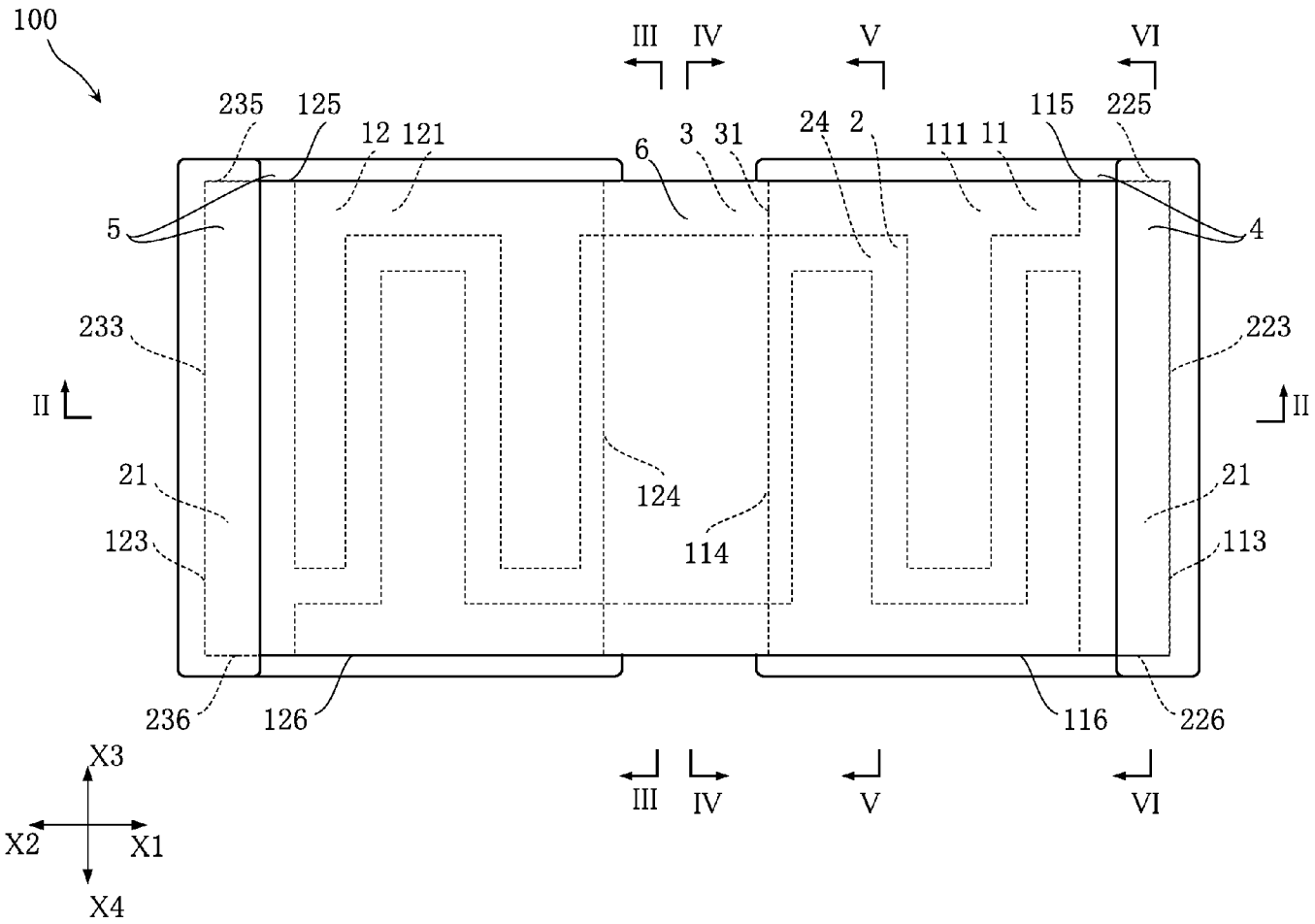
FIG. 1 is a plan view of a chip resistor according to an embodiment of the present invention.

Embodiments of the present invention are described below with reference to the accompanying drawings.

FIGS. 1-13 depict a chip resistor according to an embodiment of the present invention. The illustrated chip resistor 100 includes a first electrode 11, a second electrode 12, a resistor element 2, a bonding layer 3, a first plating layer 4, a second plating layer 5 and a protective film 6.

Figure 2:
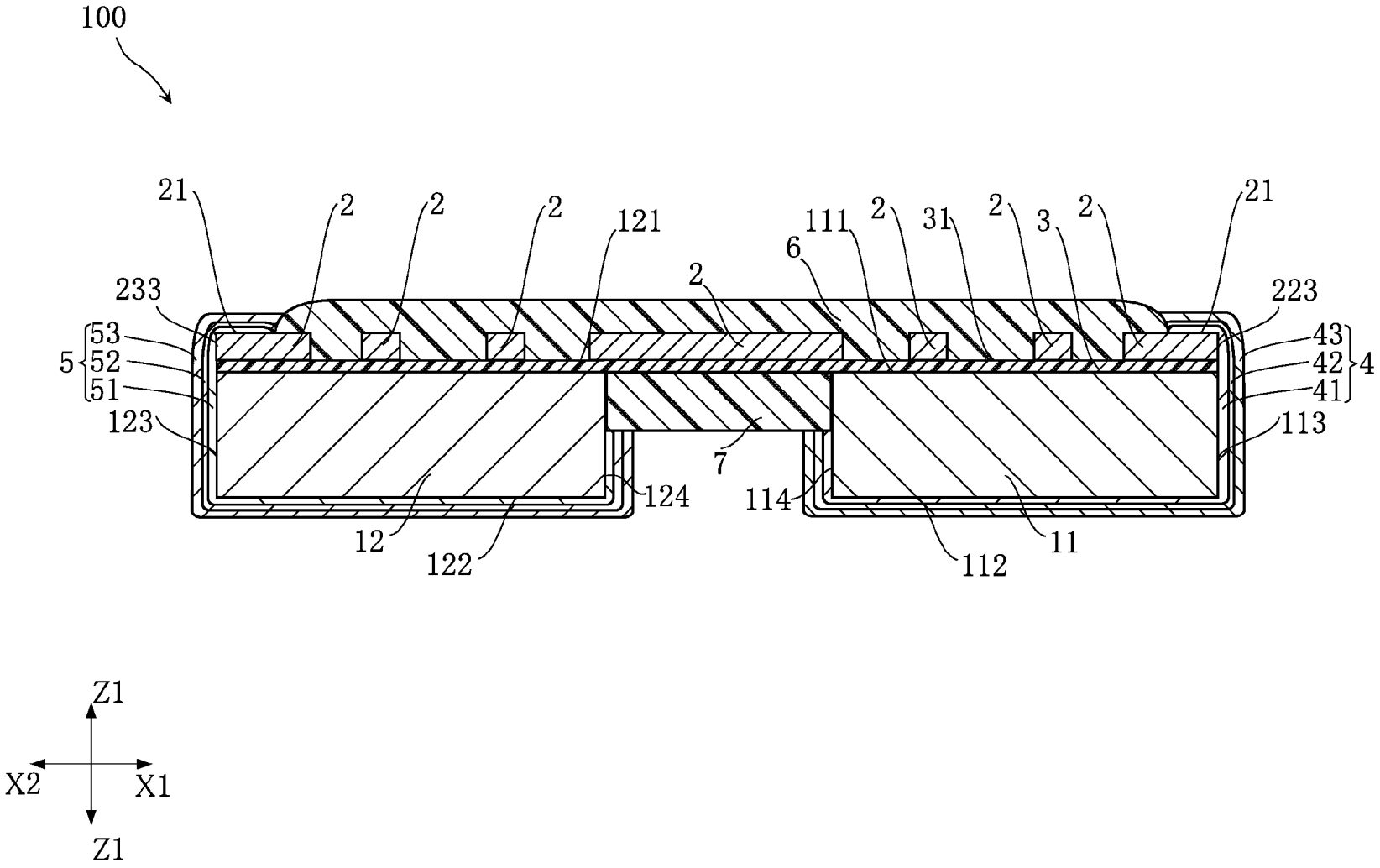
FIG. 2 is a sectional view taken along lines II-II in FIG. 1.
Figure 3:
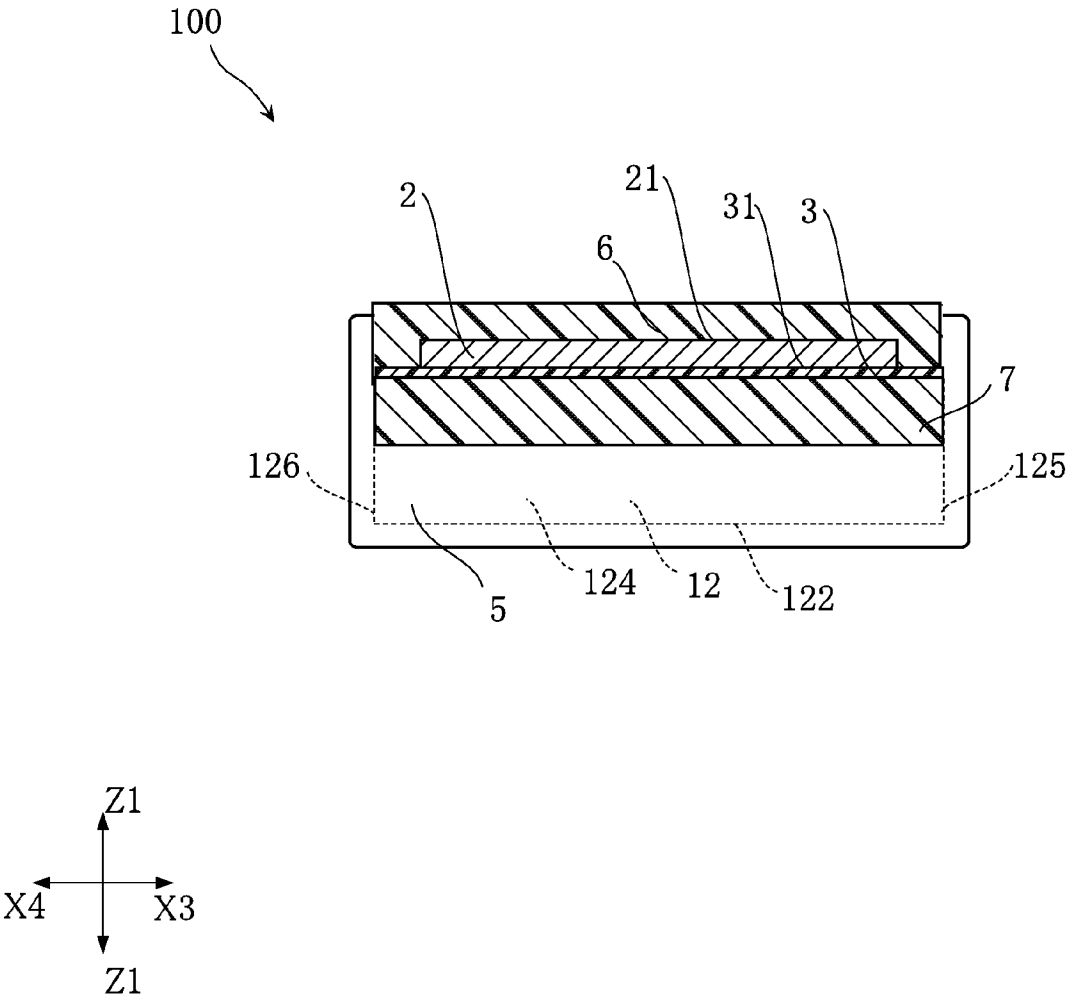
FIG. 3 is a sectional view taken along lines III-III in FIG. 1.
Figure 4:
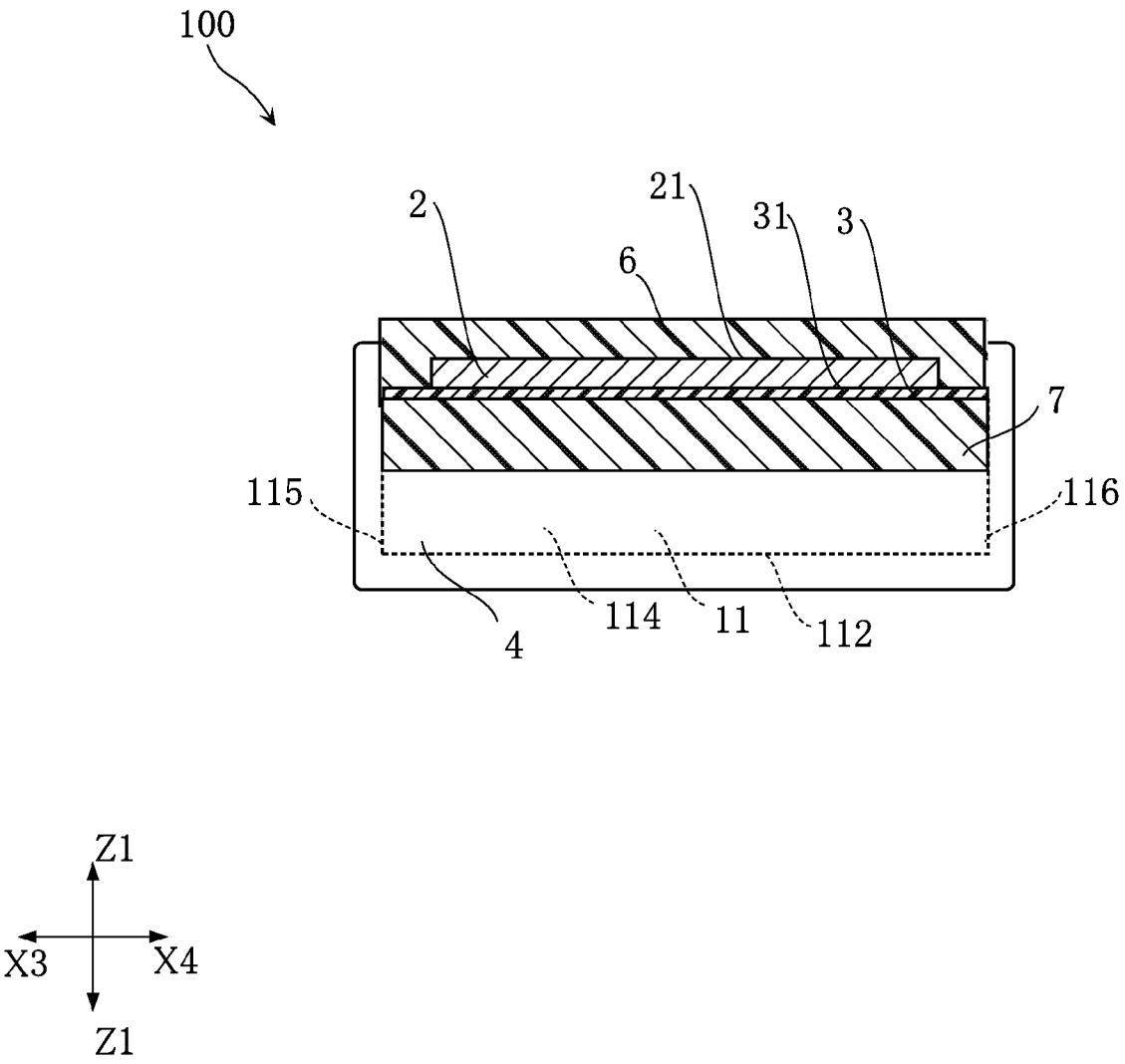
FIG. 4 is a sectional view taken along lines IV-IV in FIG. 1.
Figure 5:
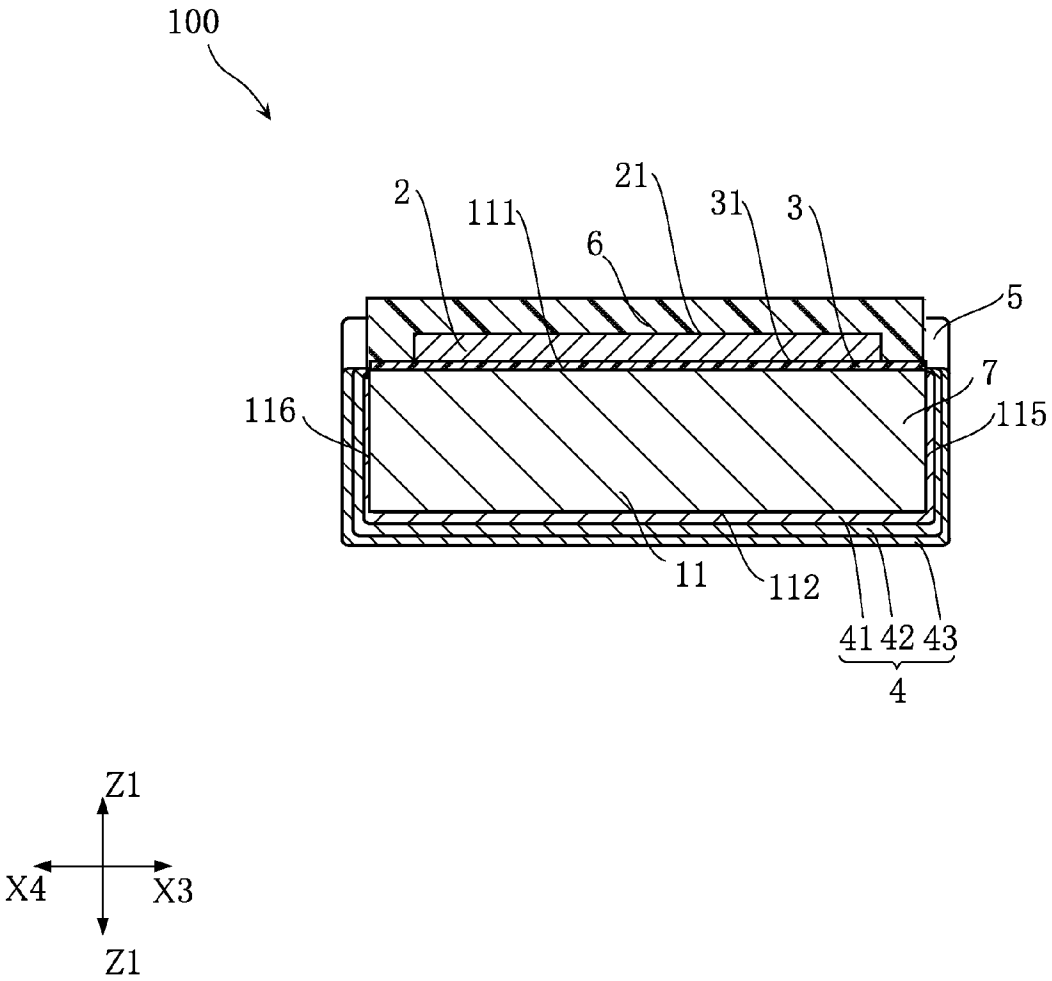
FIG. 5 is a sectional view taken along lines V-V in FIG. 1.
Figure 6:
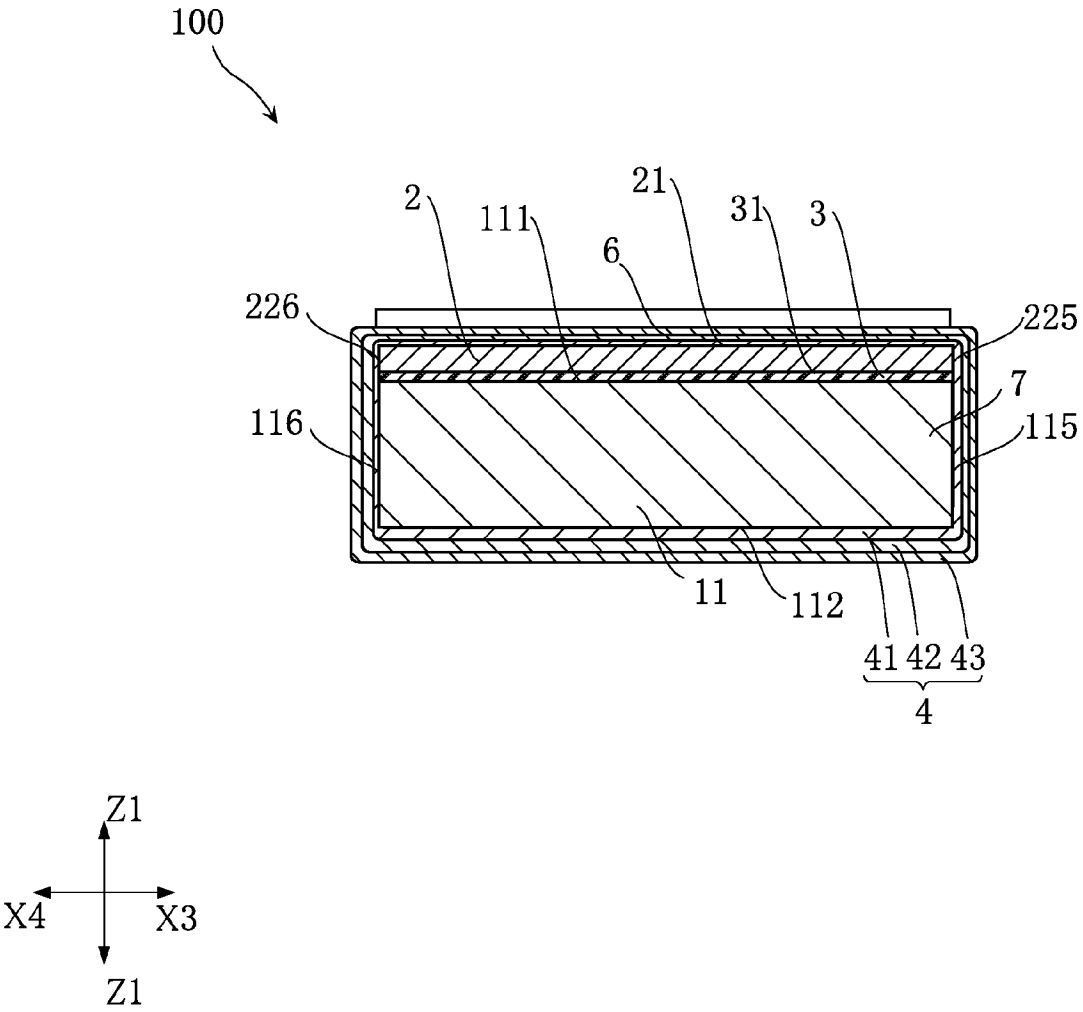
FIG. 6 is a sectional view taken along lines VI-VI in FIG. 1.
Figure 7:
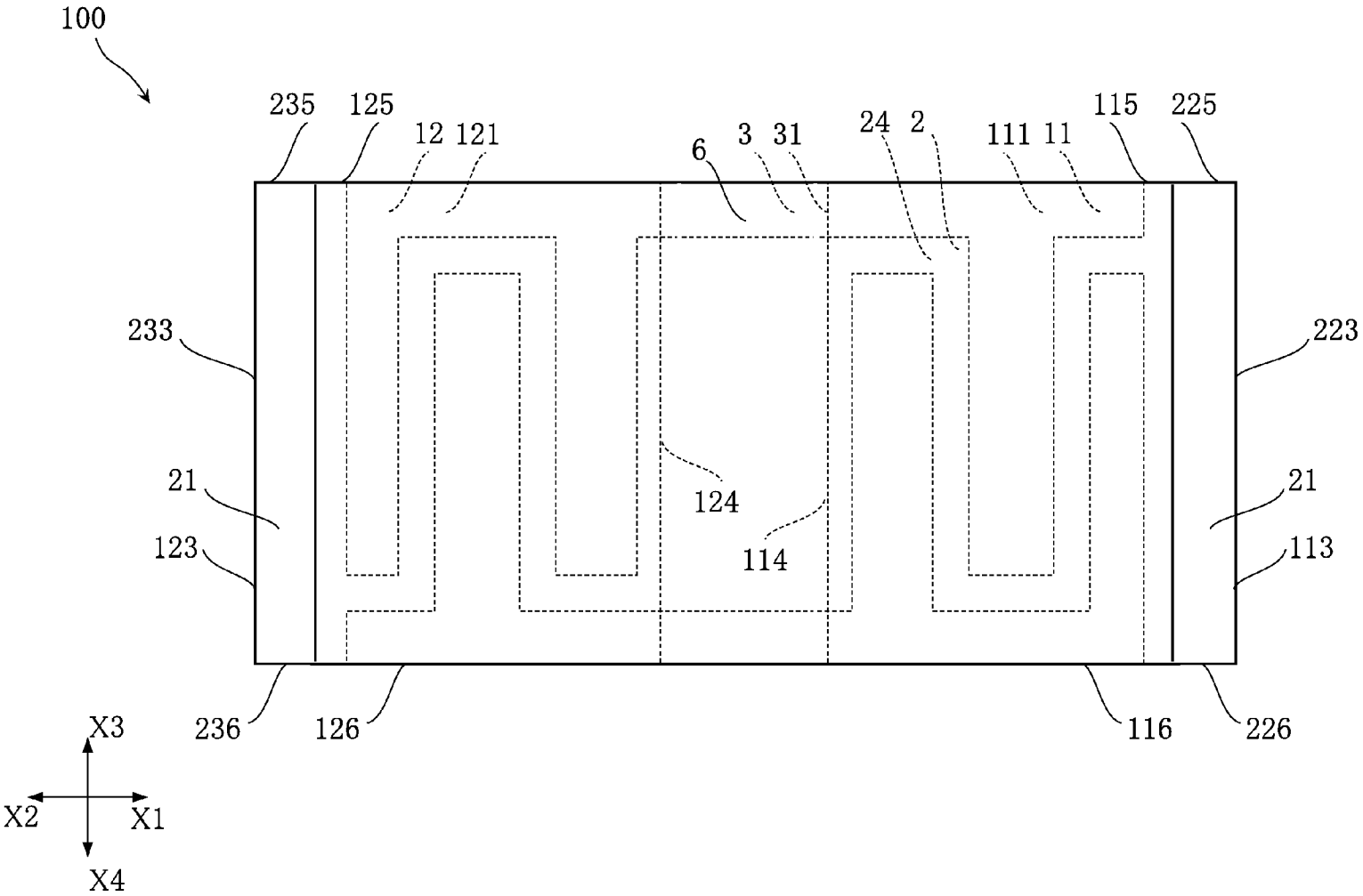
FIG. 7 is a plan view obtained by omitting a first plating layer and a second plating layer from FIG. 1.
Figure 8:
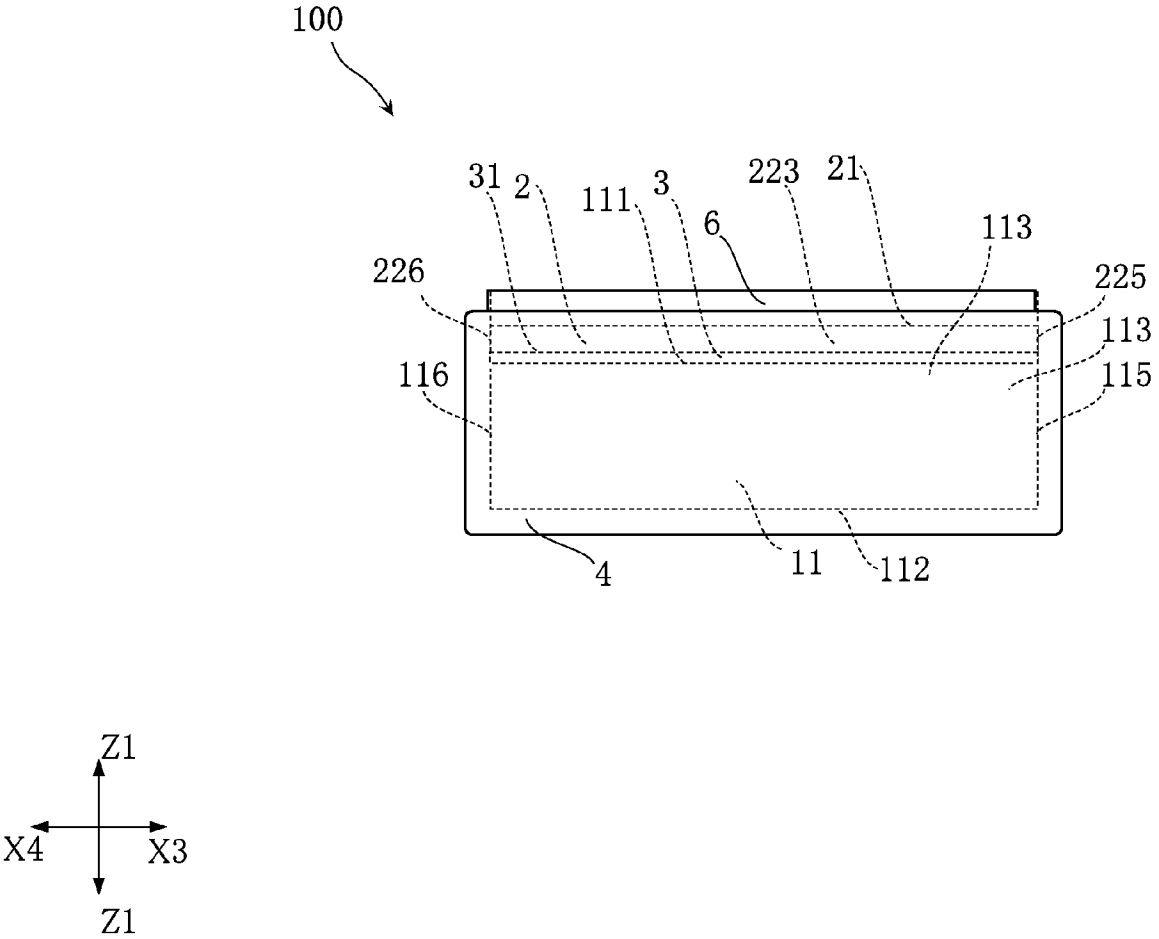
FIG. 8 is a right side view of the chip resistor shown in FIG. 1.
Figure 9:
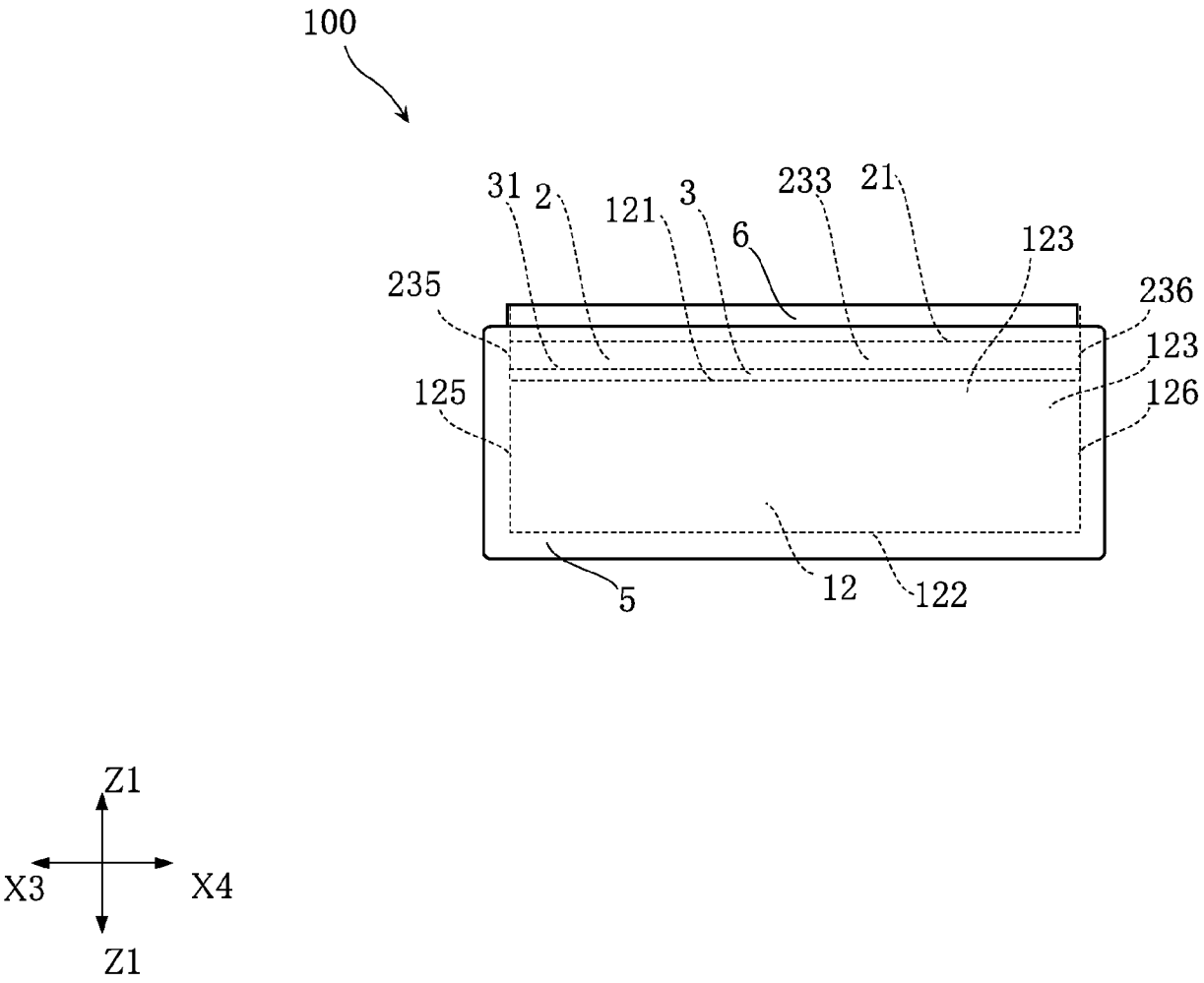
FIG. 9 is a left side view of the chip resistor shown in FIG. 1.
Figure 10:
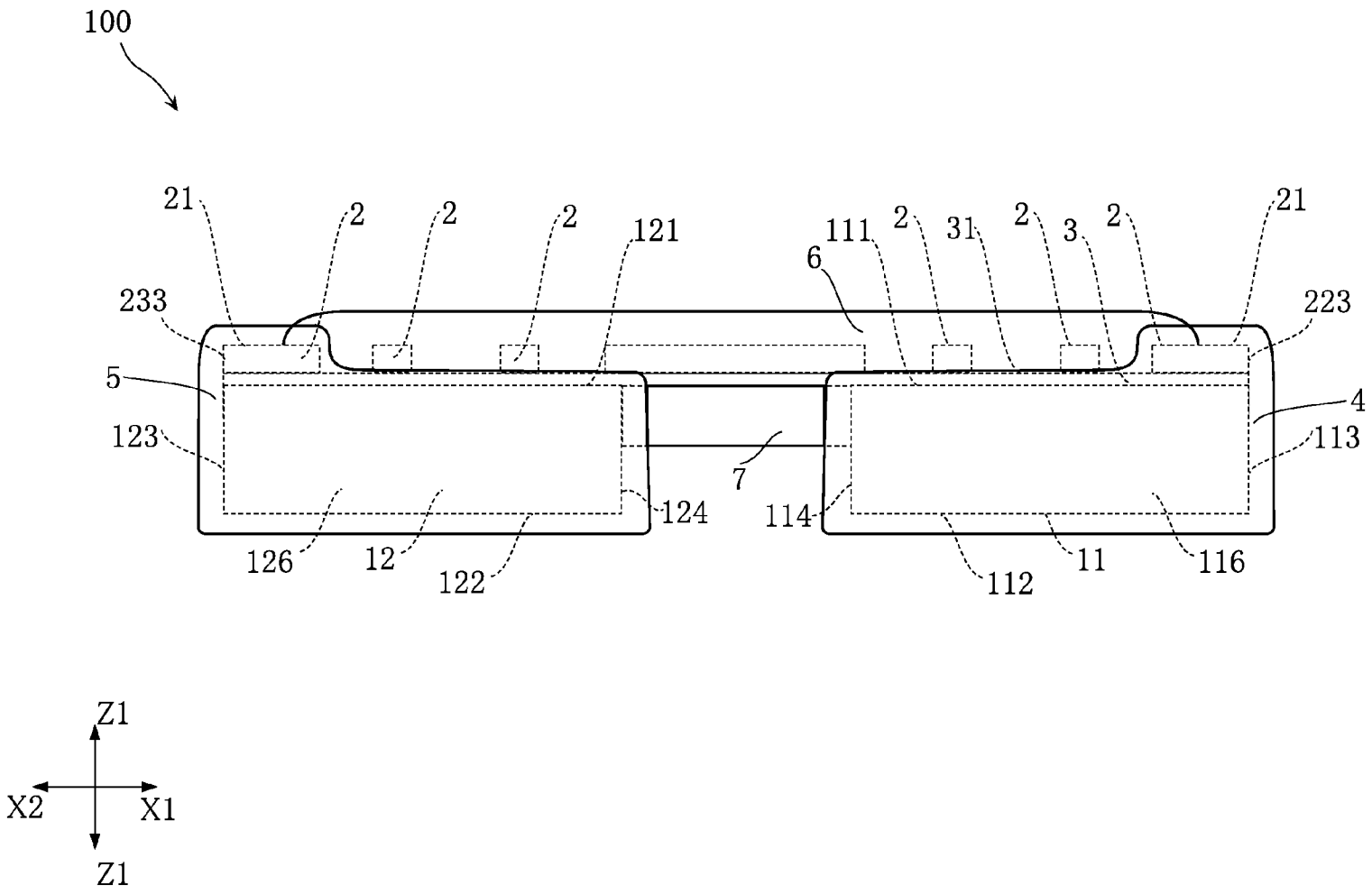
FIG. 10 is a front view of the chip resistor shown in FIG. 1.
Figure 11:
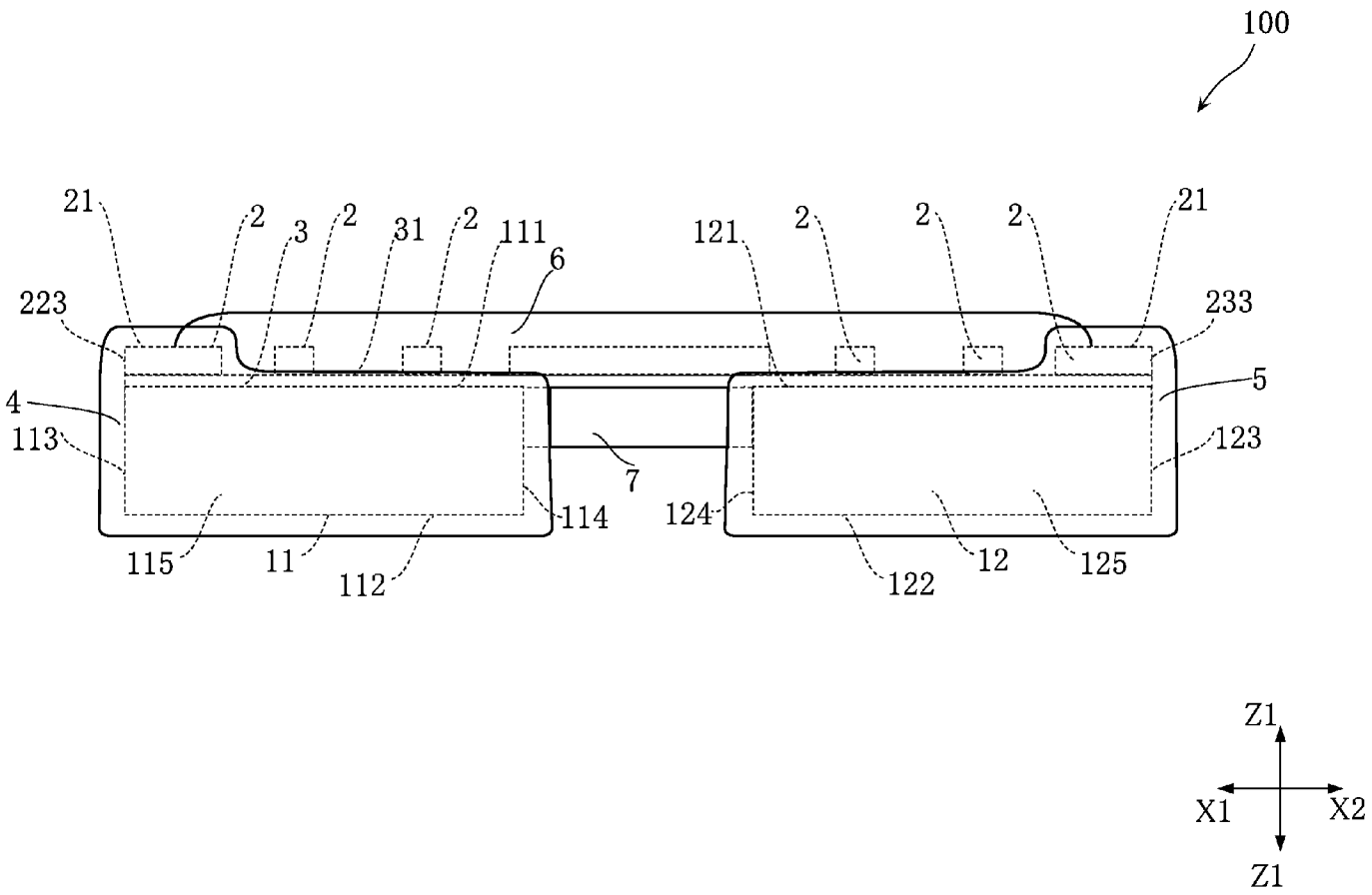
FIG. 11 is a rear view of the chip resistor shown in FIG. 1.

The first electrode 11 is in the form of a plate. The first electrode 11 is made of an electrically conductive material such as Cu, Ag, Au and Al. Heat generated at the resistor element 2 dissipates to the outside of the chip resistor 100 through the first electrode 11. In FIG. 2, the thickness direction of the first electrode 11 is indicated by arrows Z1. In FIG. 1, the first direction (corresponding to the right direction in the figure) is indicated by an arrow X1, and the second direction (corresponding to the left direction in the figure) is indicated by an arrow X2. Further, the third direction (corresponding to the upward direction in the figure) is indicated by an arrow X3, and the fourth direction (corresponding to the downward direction in the figure) is indicated by an arrow X4.

In the illustrated embodiment, the thickness (the dimension measured in the thickness direction Z1) of the first electrode 11 may be 200-800 μm. The length (the dimension measured in the first direction X1) of the chip resistor 100 may be 3-10 mm, and the width (the dimension measured in the third direction X3) of the chip resistor 100 may be 1-10 mm.

The first electrode 11 includes an obverse surface 111 (called "first-electrode obverse surface 111" below), a reverse surface 112 (called "first-electrode reverse surface 112" below), an outer side surface 113 (called "first-electrode outer side surface 113" below), an inner side surface 114 (called "first-electrode inner side surface 114" below), an end surface 115 (called "first-electrode end surface 115" below) 115 and an end surface 116 (called "first-electrode end surface 116" below). In the illustrated example, at least the first-electrode obverse surface 111, the first-electrode reverse surface 112, the first-electrode outer side surface 113, the first-electrode end surface 115 and the first-electrode end surface 116 are flat.

The first-electrode obverse surface 111 and the first-electrode reverse surface 112 face away from each other. The first-electrode obverse surface 111 faces to one side in the thickness direction Z1 (or, faces in one sense of the thickness direction Z1), whereas the first-electrode reverse surface 11 faces to the other side in the thickness direction Z1. The first-electrode outer side surface 113 faces in the first direction X1. The first-electrode inner side surface 114 faces in the second direction X2. Thus, the first-electrode outer side surface 113 and the first-electrode inner side surface 114 face away from each other. The first-electrode inner side surface 114 faces toward the second electrode 12. The first-electrode end surface 115 faces in the third direction X3. The first-electrode end surface 116 faces in the fourth direction X4. Thus, the first-electrode end surface 115 and the first-electrode end surface 116 face away from each other.

Figure 12:
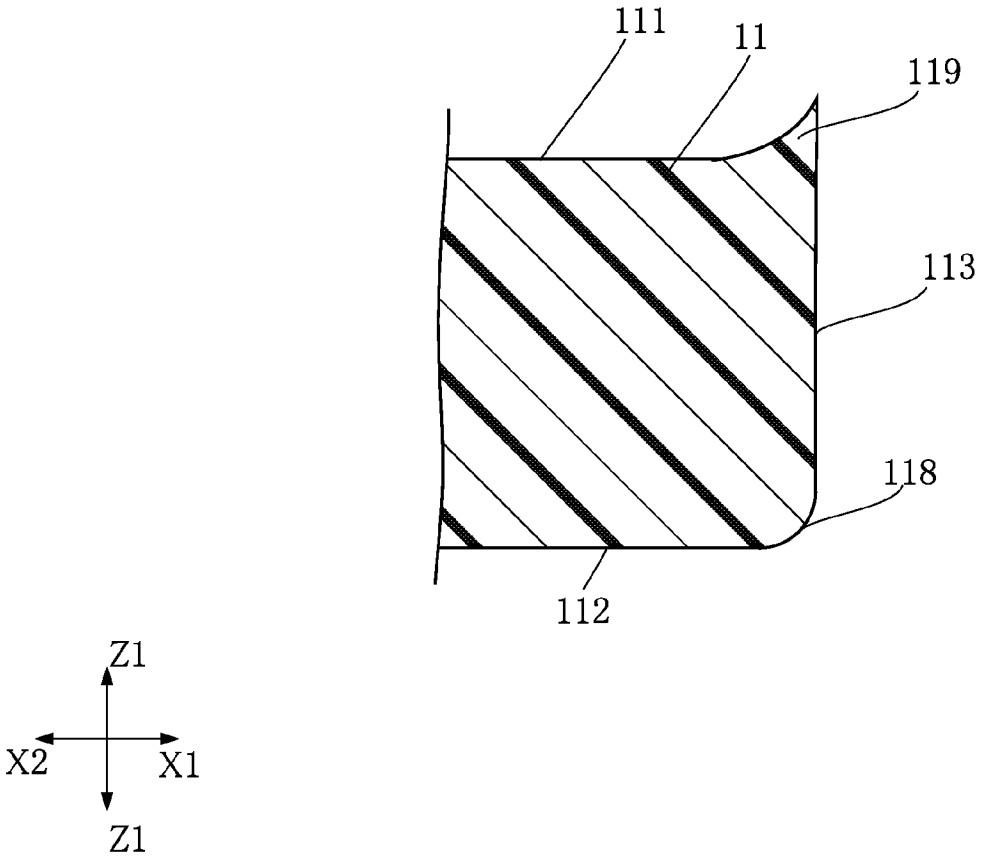
FIG. 12 is a sectional view showing the first electrode 11 of the embodiment of the present invention.

FIG. 12 is a sectional view showing the first electrode 11. As shown, the first electrode 11 includes a sharp portion 119 pointed to one side in the thickness direction Z1. The sharp portion 119 is provided at an end of the first electrode 11 in the first direction X1. In the illustrated example, the sharp portion 119 is provided at the obverse surface 111. In the illustrated example, the first electrode 11 further includes a first curved surface 118. The first curved surface 118 connects the first-electrode reverse surface 112 and the first-electrode outer side surface 113 to each other. In the illustrated example, the first curved surface 118 also connects the first-electrode reverse surface 112 and the first-electrode end surface 115 to each other and the first-electrode reverse surface 112 and the first-electrode end surface 116 to each other.

The second electrode 12 is spaced apart from the first electrode 11. Specifically, the second electrode 12 is spaced apart from the first electrode 11 in the second direction X2, opposite to the first direction X1. The second electrode 12 is in the form of a plate. The second electrode 12 is made of an electrically conductive material such as Cu, Ag, Au and Al. Heat generated at the resistor element 2 dissipates to the outside of the chip resistor 100 through the second electrode 12.

In the illustrated embodiment, the thickness (the dimension measured in the thickness direction Z1) of the second electrode 12 may be 200-800 μm.

The second electrode 12 includes a second-electrode obverse surface 121, a second-electrode reverse surface 122, a second-electrode outer side surface 123, a second-electrode inner side surface 124, a second-electrode end surface 125 and a second-electrode end surface 126. In the illustrated example, at least the second-electrode obverse surface 121, the second-electrode reverse surface 122, the second-electrode outer side surface 123, the second-electrode end surface 125 and the second-electrode end surface 126 are flat.

The second-electrode obverse surface 121 and the second-electrode reverse surface 122 face away from each other. The second-electrode obverse surface 121 faces to one side in the thickness direction Z1, whereas the second-electrode reverse surface 122 faces to the other side in the thickness direction Z1. The second-electrode outer side surface 123 faces in the second direction X2. The second-electrode inner side surface 124 faces in the first direction X1. Thus, the second-electrode outer side surface 123 and the second-electrode inner side surface 124 face away from each other. The second-electrode inner side surface 124 faces toward the first electrode 11. In the illustrated example, apart of the second-electrode inner side surface 124 faces a part of the first-electrode inner side surface 114. The second-electrode end surface 125 faces in the third direction X3. The second-electrode end surface 126 faces in the fourth direction X4. Thus, the second-electrode end surface 125 and second-electrode end surface 126 face away from each other.

Figure 13:
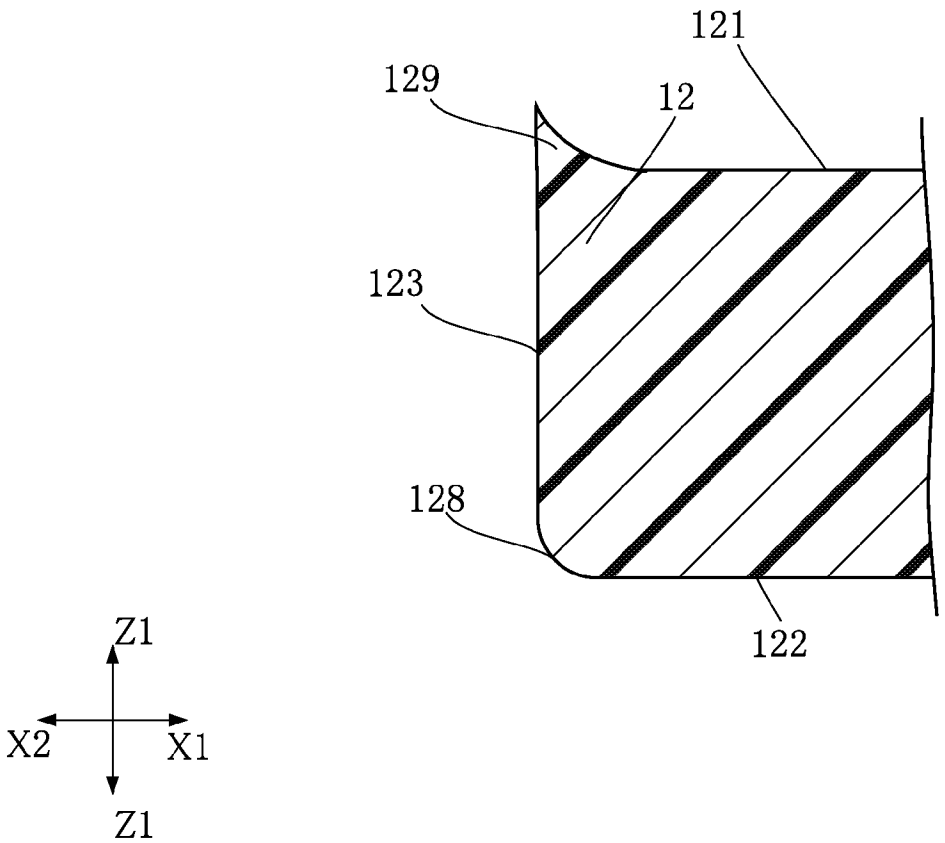
FIG. 13 is a sectional view showing the second electrode 11 of the embodiment of the present invention.

FIG. 13 is a sectional view showing the second electrode 12. In the illustrated example, as shown in FIG. 13, the second electrode 12 includes a sharp portion 129 pointed to one side in the thickness direction Z1. The sharp portion 129 is provided at an end of the second electrode 12 in the second direction X2. In the illustrated example, the sharp portion 129 is provided at the obverse surface 121. In the illustrated example, the second electrode 12 further includes a second curved surface 128. The second curved surface 128 connects the second-electrode reverse surface 112 and the second-electrode outer side surface 123 to each other. In the illustrated example, the second curved surface 128 also connects the second-electrode reverse surface 122 and the second-electrode end surface 125 to each other and the second-electrode reverse surface 122 and the second-electrode end surface 126 to each other.

As shown in FIG. 2, the resistor element 2 is provided on both the first electrode 11 and the second electrode 12. Specifically, the resistor element 2 is arranged on the first-electrode obverse surface 111 of the first electrode 11 and also the second-electrode obverse surface 121 of the second electrode 12. For instance, the thickness (the dimension measured in the thickness direction Z1) of the resistor element 2 is 50-150 μm. In the illustrated example, the resistor element 2 includes a serpentine portion, as viewed in the thickness direction Z1. The serpentine shape of the resistor element 2 is advantageous in increasing the resistance of the resistor element 2. Alternatively, unlike the illustrated example, the resistor element 2 may not be in the form of a serpentine but may be in the form of a strip elongated straight in the X1-X2 direction. The resistor element 2 is made of a resistive metal material such as manganin, zeranin, Ni—Cr alloy, Cu—Ni alloy or Fe—Cr alloy.

As shown in FIGS. 1 and 2, the resistor element 2 includes an obverse surface ("resistor element obverse surface") 21, a first side surface ("first resistor-element side surface") 223, a first end surface ("first resistor-element end surface") 225, a first end surface ("first resistor-element end surface") 226, a second side surface ("second resistor-element side surface") 233, a second end surface ("second resistor-element end surface") 235 and a second end surface ("second resistor-element end surface") 236. In the illustrated example, all of the resistor element obverse surface 21, the first resistor-element side surface 223, the first resistor-element end surface 225, the first resistor-element end surface 226, the second resistor-element side surface 233, the second resistor-element end surface 235 and the second resistor-element end surface 236 are flat.

The resistor element obverse surface 21 faces to the upper side in FIG. 2. The first resistor-element side surface 223 faces in the first direction X1. The first resistor-element side surface 223 is flush with the first-electrode outer side surface 113. The first resistor-element end surface 225 faces in the third direction X3. The first resistor-element end surface 225 is flush with the first-electrode end surface 115. The first resistor-element end surface 226 faces in the fourth direction X4. The first resistor-element end surface 226 is flush with the first-electrode end surface 116. The second resistor-element side surface 233 faces in the second direction X2. The second resistor-element side surface 233 is flush with the second-electrode outer side surface 123. The second resistor-element end surface 235 faces in the third direction X3. The second resistor-element end surface 235 is flush with the second-electrode end surface 125. The second resistor-element end surface 236 faces in the fourth direction X4. The second resistor-element end surface 236 is flush with the second-electrode end surface 126.

The bonding layer 3 is provided between the first electrode 11 and the resistor element 2 and also between the second electrode 12 and the resistor element 2. Specifically, the bonding layer 3 is provided between the first-electrode obverse surface 111 of the first electrode 11 and the resistor element 2 and between the second-electrode obverse surface 121 of the second electrode 12 and the resistor element 2. The bonding layer 3 bonds the resistor element 2 to the first-electrode obverse surface 111 and the second-electrode obverse surface 121. Preferably, the bonding layer 3 is made of an insulating material. For instance, an epoxy-based material may be used as the insulating material. It is preferable that the material forming the bonding layer 3 has high thermal conductivity so that heat generated at the resistor element 2 easily dissipates to the outside of the chip resistor 100 through the bonding layer 3. For instance, the thermal conductivity of the material forming the bonding layer 3 is 0.5-3.0 W/(m·K). For instance, the thickness (the dimension measured in the thickness direction Z1) of the bonding layer 3 is 30-100 μm. As shown in FIGS. 2-6, in the illustrated example, the bonding layer 3 covers the entirety of the first-electrode obverse surface 111 and the entirety of the second-electrode obverse surface 121.

Alternatively, unlike the illustrated example, the bonding layer 3 may be formed only at a part of the first-electrode obverse surface 111. For instance, the bonding layer 3 may be formed only at a region of the first-electrode obverse surface 111 which overlaps the resistor element 2. Similarly, the bonding layer 3 may be formed only at a part of the second-electrode obverse surface 121. For instance, the bonding layer 3 may be formed only at a region of the second-electrode obverse surface 121 which overlaps the resistor element 2.

As shown in FIGS. 2-6, the bonding layer 3 has a bonding layer obverse surface 31. The bonding layer obverse surface 31 faces in the same direction as the first-electrode obverse surface 111 (i.e., upward in FIG. 2). The bonding layer obverse surface 31 is held in direct contact with the resistor element 2.

As shown in FIG. 2, the first plating layer 4 is electrically connected to the resistor element 2. According to the present invention, the first plating layer 4 directly covers at least a part of the first-electrode outer side surface 113 in a manner such that the covering portion of the plating layer 4 extends continuously in the third direction X3, from one edge of the side surface 113 to the other edge of the same. In the illustrated example, the first plating layer 4 directly covers the entirety of the first-electrode outer side surface 113. Also, in the illustrated example, the first plating layer 4 directly covers the first-electrode reverse surface 112, the first-electrode inner side surface 114, the first-electrode end surface 115 and the first-electrode end surface 116. Unlike the illustrated example, the first plating layer 4 may not directly cover all of the first-electrode reverse surface 112, the first-electrode inner side surface 114, the first-electrode end surface 115 and the first-electrode end surface 116. For instance, one or more of these surfaces may be exposed, partially or entirely, from the first plating layer 4.

The first plating layer 4 includes a first inner plating film 41 and a first outer plating film 43. For instance, the first inner plating film 41 is made of Cu, Ag or Au. The first inner plating film 41 directly covers the first-electrode outer side surface 113. In the illustrated example, the first inner plating film 41 directly covers the entirety of the first-electrode outer side surface 113. Also, in the illustrated example, the first inner plating film 41 directly covers the first-electrode reverse surface 112, the first-electrode inner side surface 114, the first-electrode end surface 115 and the first-electrode end surface 116. The first outer plating film 43 is provided on the first inner plating film 41. In mounting the chip resistor 100 to e.g., a printed circuit board, solder adheres to the first outer plating film 43. The first outer plating film 43 is made of Sn, for example.

In the illustrated example, the first plating layer 4 includes a first intermediate plating film 42. The first intermediate plating film 42 is provided between the first inner plating film 41 and the first outer plating film 43. The first intermediate plating film 42 is made of Ni, for example. Unlike the illustrated example, the first plating layer 4 may not include the first intermediate plating film 42, and the first inner plating film 41 and the first outer plating film 43 may be held in direct contact with each other.

The first inner plating film 41 may be 10-50 μm in thickness, the first intermediate plating film 42 may be 1-10 μm in thickness and the first outer plating film 43 may be 1-10 μm in thickness.

As shown in FIG. 2, the second plating layer 5 is electrically connected to the resistor element 2. According to the present invention, the second plating layer 5 directly covers at least a part of the second-electrode outer side surface 123 in a manner such that the covering portion of the plating layer 5 extends continuously in the third direction X3, from one edge of the side surface 123 to the other edge of the same. In the illustrated example, the second plating layer 5 directly covers the entirety of the second-electrode outer side surface 123. Also, in the illustrated example, the second plating layer 5 directly covers the second-electrode reverse surface 122, the second-electrode inner side surface 124, the second-electrode end surface 125 and the second-electrode end surface 126. Unlike the illustrated example, the second plating layer 5 may not directly cover all of the second-electrode reverse surface 122, the second-electrode inner side surface 124, the second-electrode end surface 125 and the second-electrode end surface 126. For instance, one or more of these surfaces may be exposed, partially or entirely, from the second plating layer 5.

The second plating layer 5 includes a second inner plating film 51 and a second outer plating film 53. For instance, the second inner plating film 51 is made of Cu, Ag or Au. The second inner plating film 51 directly covers the second-electrode outer side surface 123. In the illustrated example, the second inner plating film 51 directly covers the entirety of the second-electrode outer side surface 123. Also, the second inner plating film 51 directly covers the second-electrode reverse surface 122, the second-electrode inner side surface 124, the second-electrode end surface 125 and the second-electrode end surface 126. The second outer plating film 53 is provided on the second inner plating film 51. In mounting the chip resistor 100 to e.g., a printed circuit board, solder adheres to the second outer plating film 53. The second outer plating film 53 is made of Sn, for example.

In the illustrated example, the second plating layer 5 includes a second intermediate plating film 52. The second intermediate plating film 52 is provided between the second inner plating film 51 and the second outer plating film 53. For instance, the second intermediate plating film 52 is made of Ni. Unlike the illustrated example, the second plating layer 5 may not include the second intermediate plating film 52, and the second inner plating film 51 and the second outer plating film 53 may be held in direct contact with each other.

The second inner plating film 51 may be 10-50 μm in thickness, the second intermediate plating film 52 may be 1-10 μm in thickness and the second outer plating film 53 may be 1-10 μm in thickness.

The protective film 6 has insulating properties and covers the resistor element 2. The protective film 6 is made of an epoxy-based material. In the illustrated example, the protective film 6 directly covers the bonding layer 3 (specifically, the bonding layer obverse surface 31 of the bonding layer 3). The protective film 6 is held in contact with the first plating layer 4 and the second plating layer 5. The protective film 6 may be made of a thermosetting material. The maximum thickness of the protective film 6 (the maximum dimension measured in the thickness direction Z1) may be 100-250 μm.

The heat conductive portion 7 has insulating properties and is provided between the first electrode 11 and the second electrode 12. The heat conductive portion 7 is made of an epoxy-based material. In the illustrated example, the heat conductive portion 7 directly covers the bonding layer 3 (specifically, the reverse surface of the bonding layer 3). The heat conductive portion 7 is held in direct contact with the first-electrode inner side surface 114 of the first electrode 11 and the second-electrode inner side surface 124 of the second electrode 12. For instance, the heat conductive portion 7 is made of a thermosetting material. In the illustrated example, the heat conductive portion 7 is held in direct contact with the first plating layer 4 and the second plating layer 5. In order that heat generated at the resistor element 2 can easily dissipate to the outside of the chip resistor 100 through the heat conductive portion 7, it is preferable that the thermal conductivity of the material forming the heat conductive portion 7 is higher than that of the material forming the protective film 6. For instance, the thermal conductivity of the material forming the heat conductive portion 7 is 0.5-3.0 W/(m·K).

A method for making the chip resistor 100 is described below.

Figure 14:
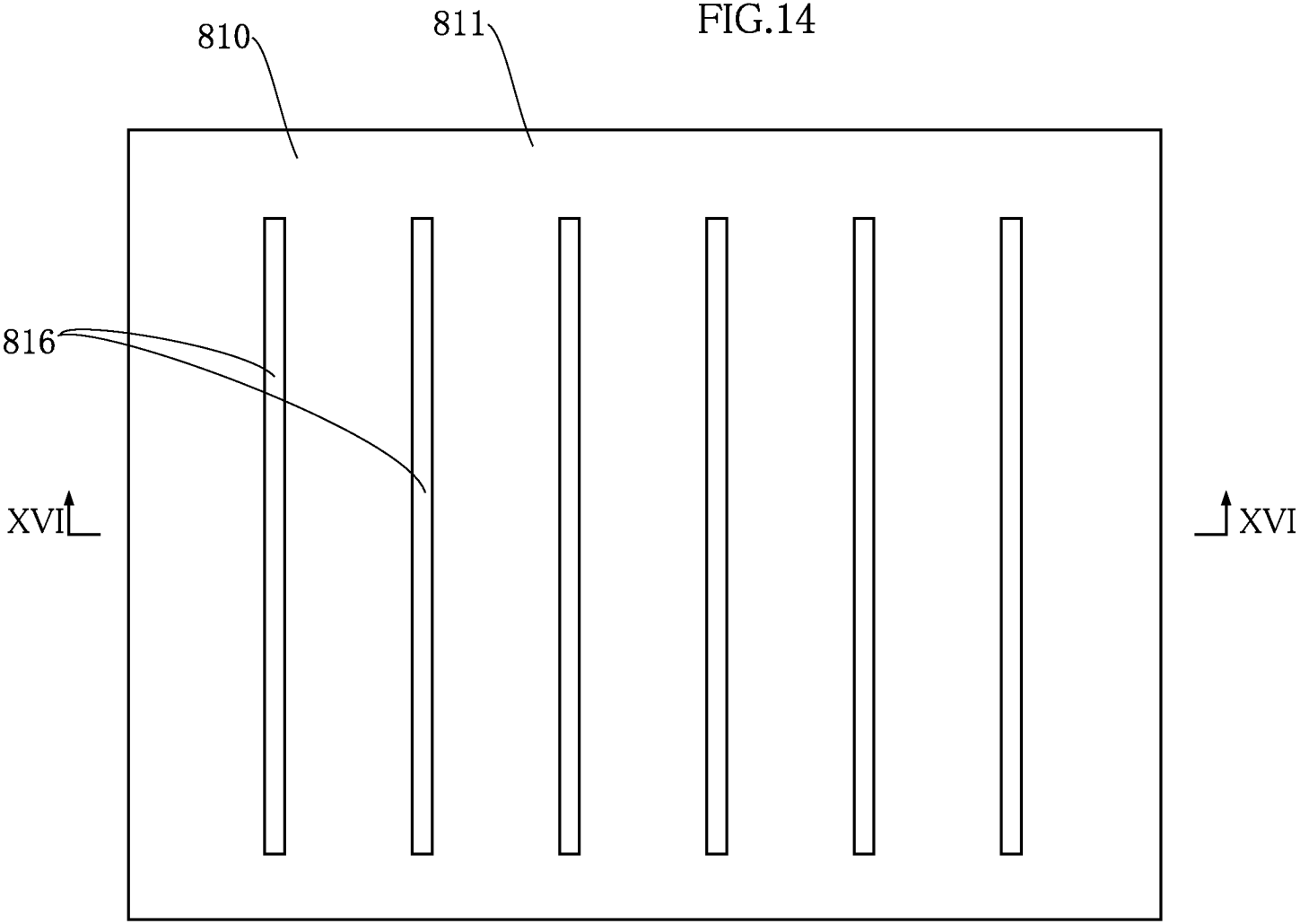
FIG. 14 is a plan view showing a step of a method for making the chip resistor shown in FIG. 1.
Figure 15:
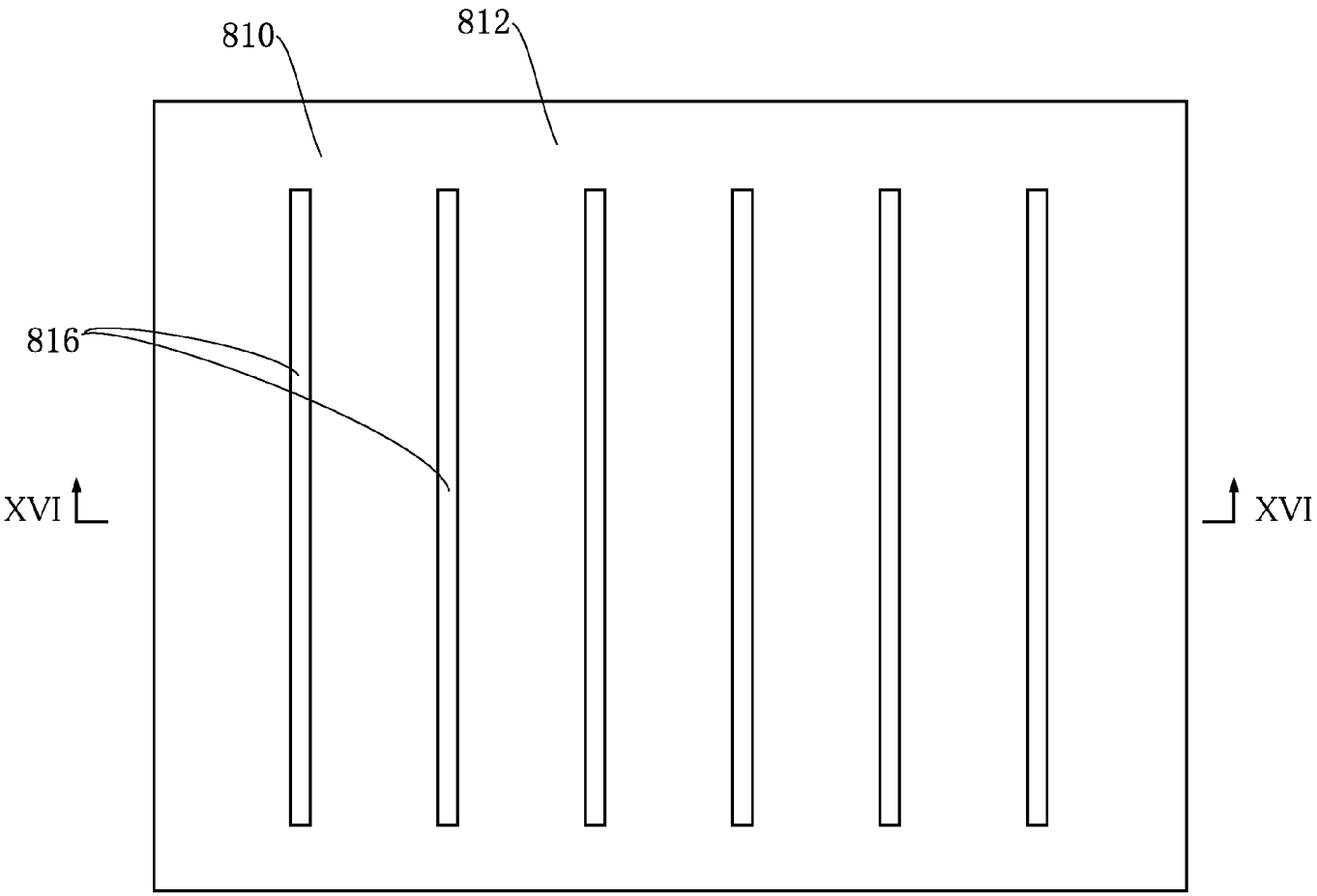
FIG. 15 is a reverse side view showing a step of a method for making the chip resistor shown in FIG. 1.
Figure 16:
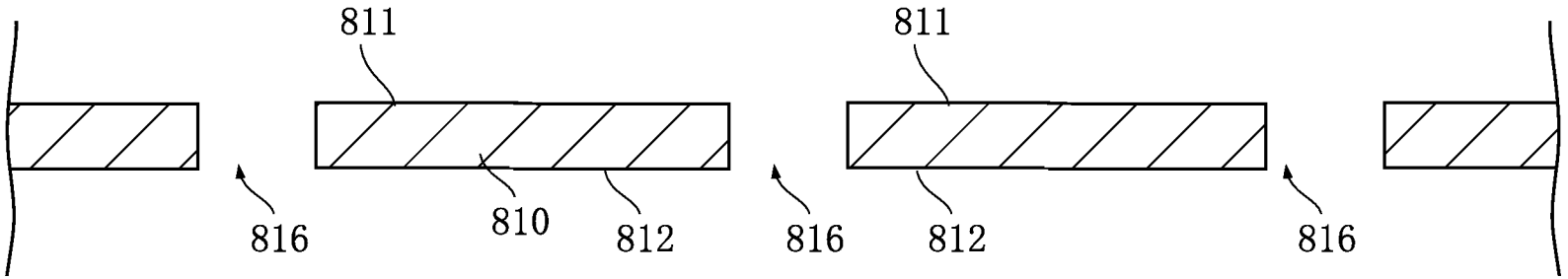
FIG. 16 is a sectional view taken along lines XVI-XVI in FIGS. 14 and 15.

First, as shown in FIGS. 14-16, abase 810 is prepared. FIG. 14 shows the base obverse surface 811 of the base 810. FIG. 15 shows the base reverse surface 812 of the base 810. The base 810 is to become the above-described first electrode 11 and second electrode 12. The base 810 is made of an electrically conductive material such as Cu, Ag, Au and Al. The base 810 is formed with a plurality of grooves 816. Each groove 816 is elongated in one direction. The groove 816 penetrates the base 810 from the base obverse surface 811 to the base reverse surface 812. The inner surfaces of the groove 816 are to become the above-described first-electrode inner side surface 114 and the second-electrode inner side surface 124. The grooves 816 are formed by etching or punching, for example.

Figure 17:
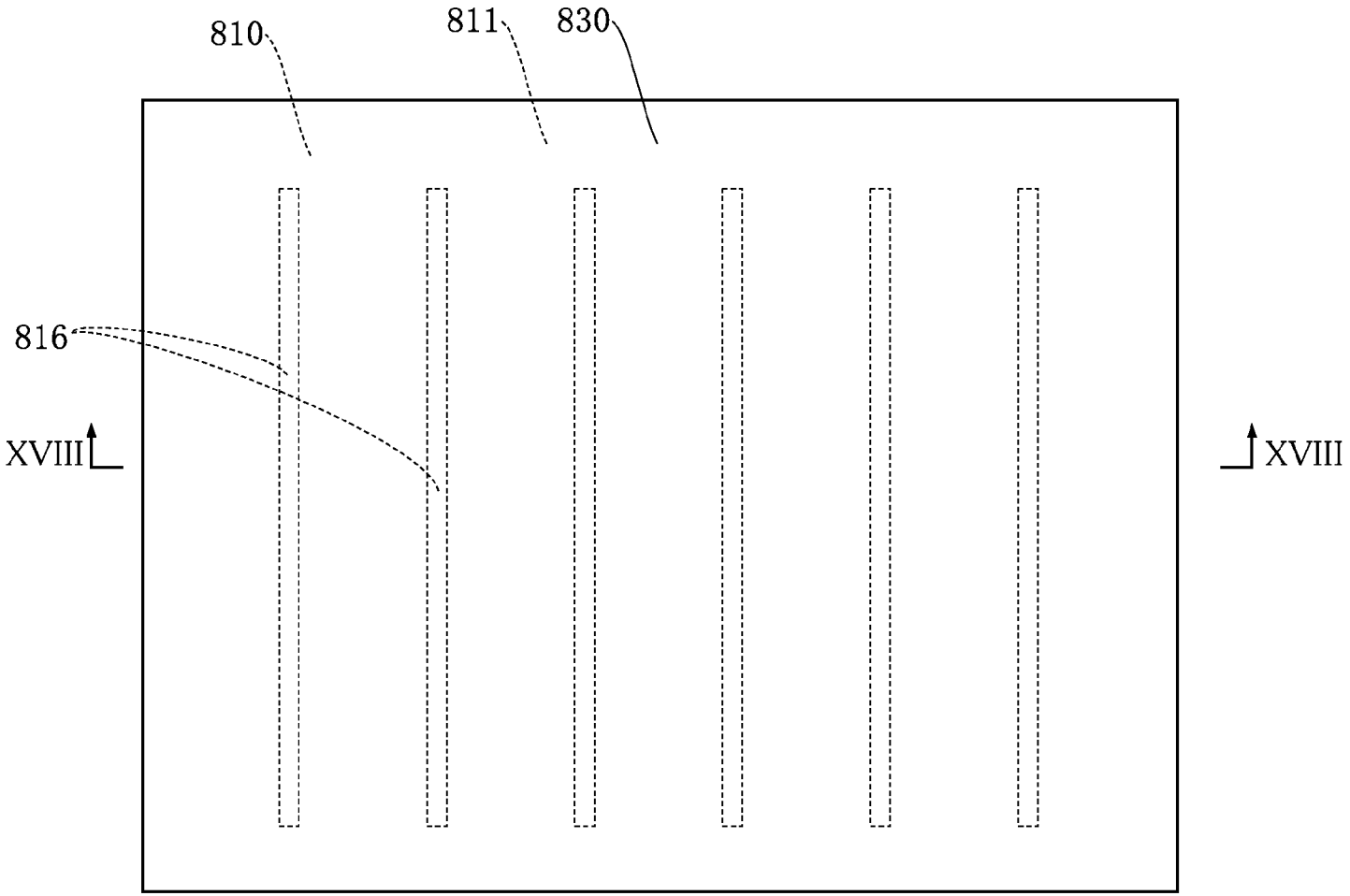
FIG. 17 is a plan view showing a step subsequent to FIGS. 14-16.
Figure 18:
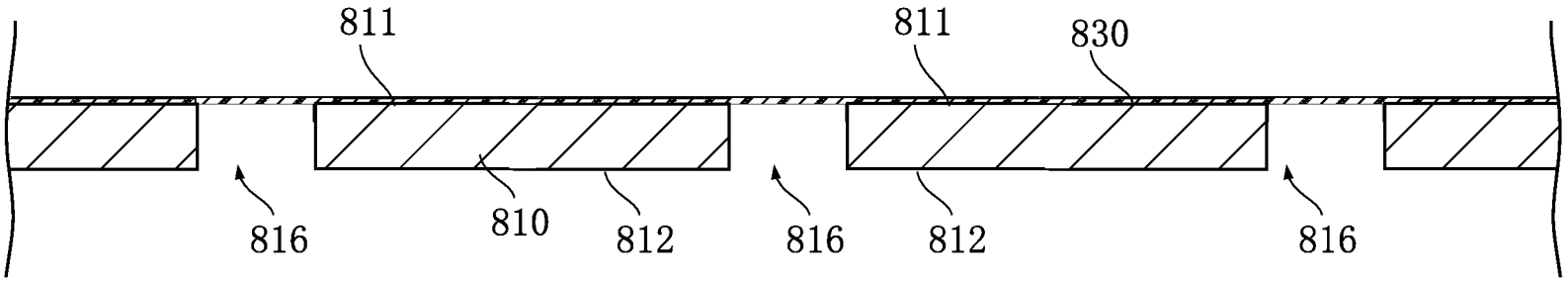
FIG. 18 is a sectional view taken along lines XVIII-XVIII in FIG. 17.

Then, as shown in FIGS. 17 and 18, a bonding material 830 is attached to the base obverse surface 811 of the base 810. The bonding material 830 is to become the above-described bonding layer 3. In the illustrated example, the bonding material 830 is a heat conductive adhesive sheet. In the state shown in FIGS. 17 and 18, the bonding material 830 is temporarily bonded to the base obverse surface 811 of the base 810 by thermocompression bonding. Part of the bonding material 830 may be provided in the grooves 816.

Figure 19:
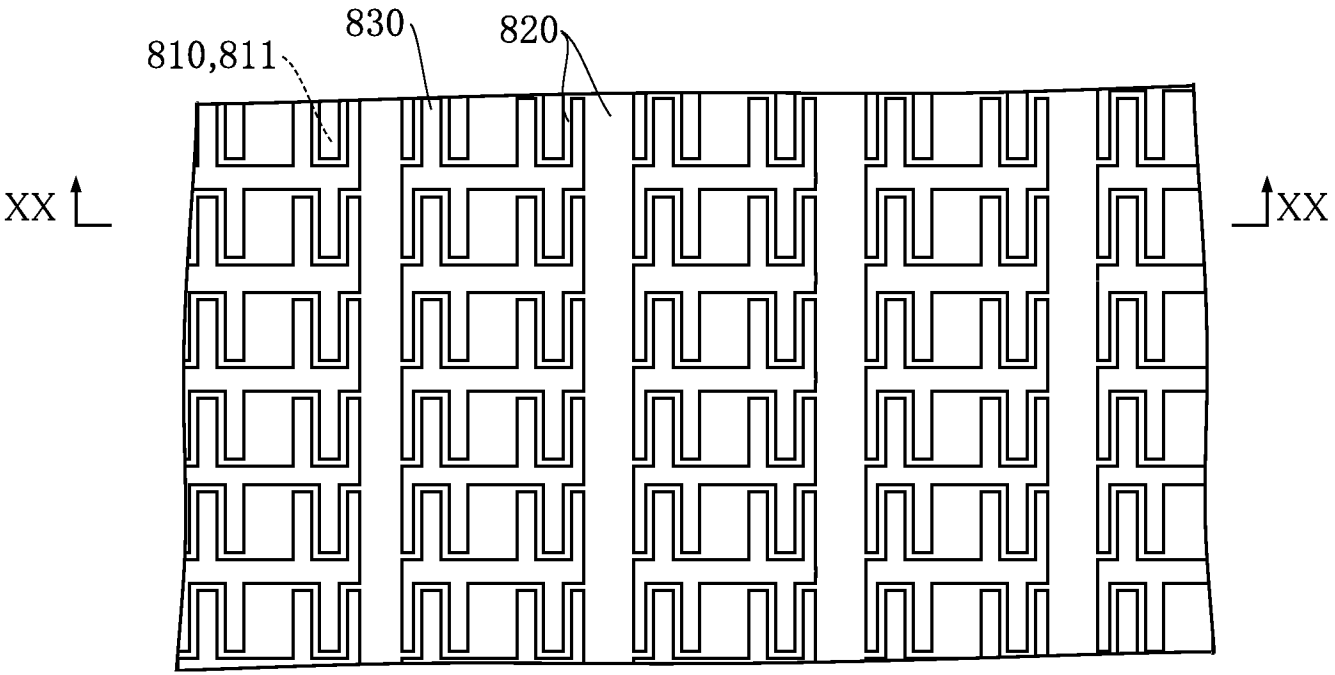
FIG. 19 is partially enlarged plan view showing a step subsequent to FIG. 17.
Figure 20:
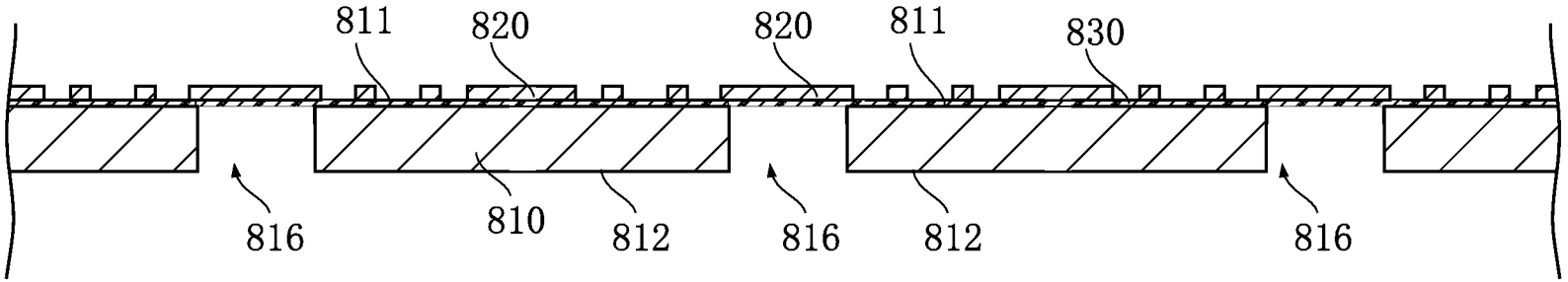
FIG. 20 is a sectional view taken along lines XX-XX in FIG. 19.

Then, as shown in FIGS. 19 and 20, the resistor element material 820 is bonded to the base obverse surface 811 by the bonding material 830. In the illustrated example, in the state shown in FIGS. 19 and 20, the resistor element material 820 is temporarily pressure-bonded to the bonding material 830. The resistor element material 820 has a plurality of portions which are to become the above-described resistor elements 2. In the illustrated example, to make the resistor element 2 in the form of a serpentine, a plurality of serpentine portions are formed in the resistor element material 820 by etching or with a punching die before the resistor element material 820 is bonded to the base obverse surface 811.

Unlike the illustrated example, the resistor element material 820 may be bonded to the base obverse surface 811 of the base 810 by using a liquid adhesive as the bonding material 830, instead of a sheet member.

Then, the resistor element material 820 is subjected to trimming (not shown) for adjusting the resistance of the resistor element 2. For instance, the trimming is performed by using laser, a sandblast, a dicer or a grinder.

Figure 21:
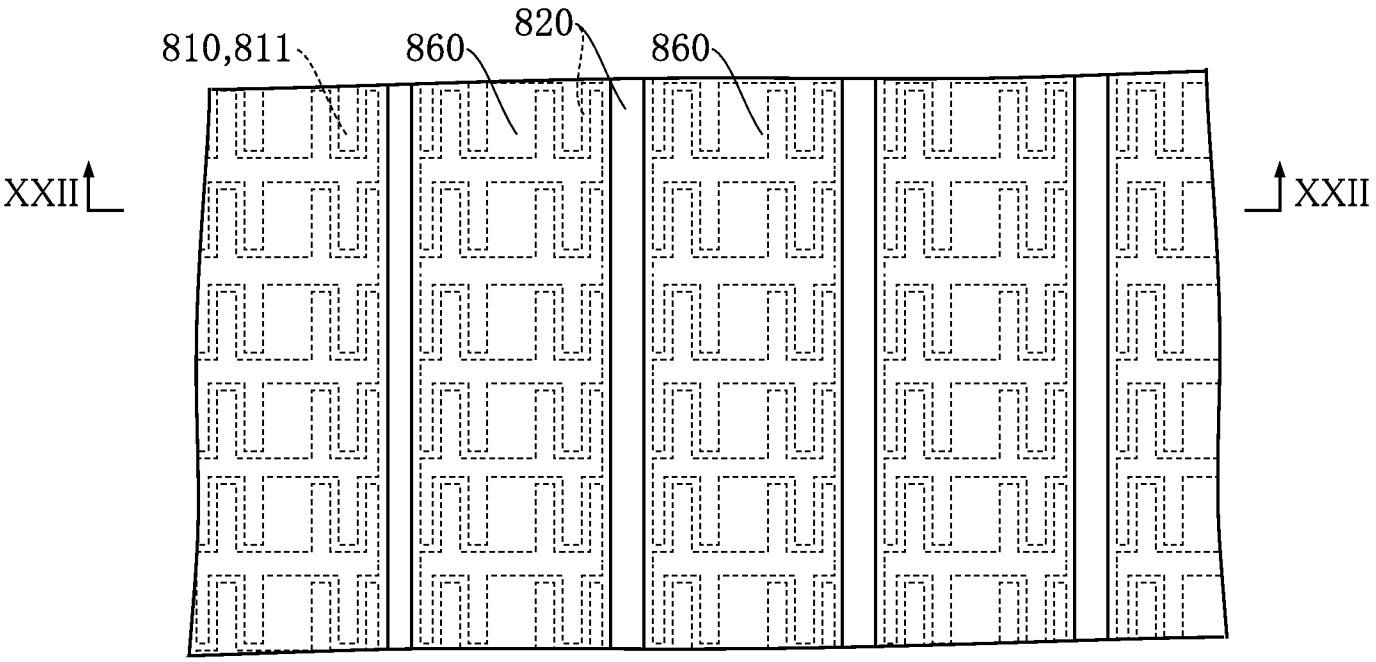
FIG. 21 is partially enlarged plan view showing a step subsequent to FIG. 19.
Figure 22:
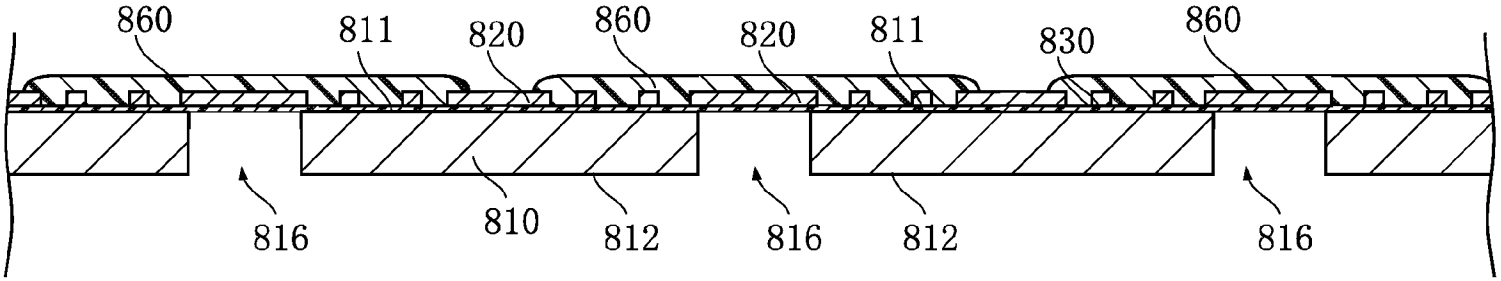
FIG. 22 is a sectional view taken along lines XXII-XXII in FIG. 21.

Then, as shown in FIGS. 21 and 22, an insulating protective film 860 is formed. The protective film 860 is to become the above-described protective film 6. The protective film 860 is formed as a plurality of strips elongated in one direction. For instance, the protective film 860 is formed by printing or other application methods.

Figure 23:
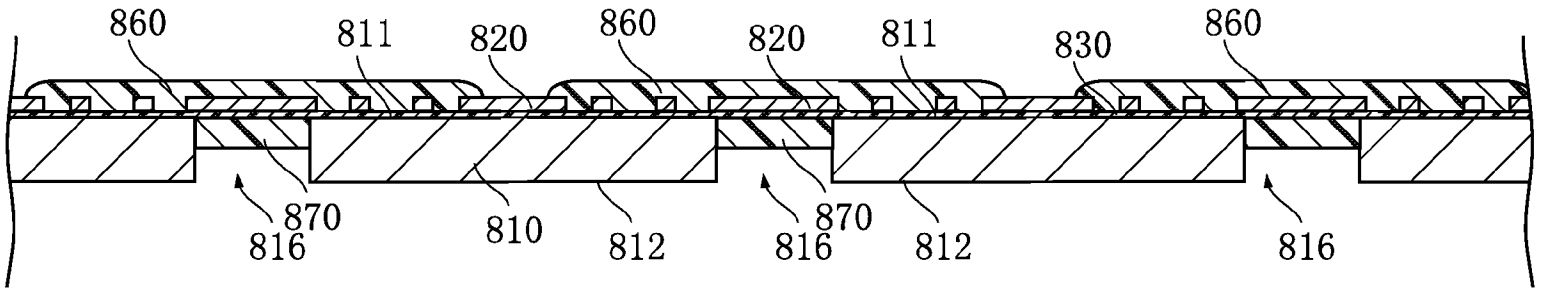
FIG. 23 is a sectional view showing a step subsequent to FIG. 22.

Then, as shown in FIG. 23, heat conductive portions 870 are formed. The heat conductive portions 870 are to become the above-described heat conductive portions 7. The heat conductive portions 870 are formed in the grooves 816, respectively, each of which is in the form of a strip elongated in one direction. For instance, the heat conductive portions 870 are formed by printing or other application methods.

Then, though not illustrated, the intermediate product shown in FIG. 23 is hardened at e.g. 150-200° C.

Figure 24:
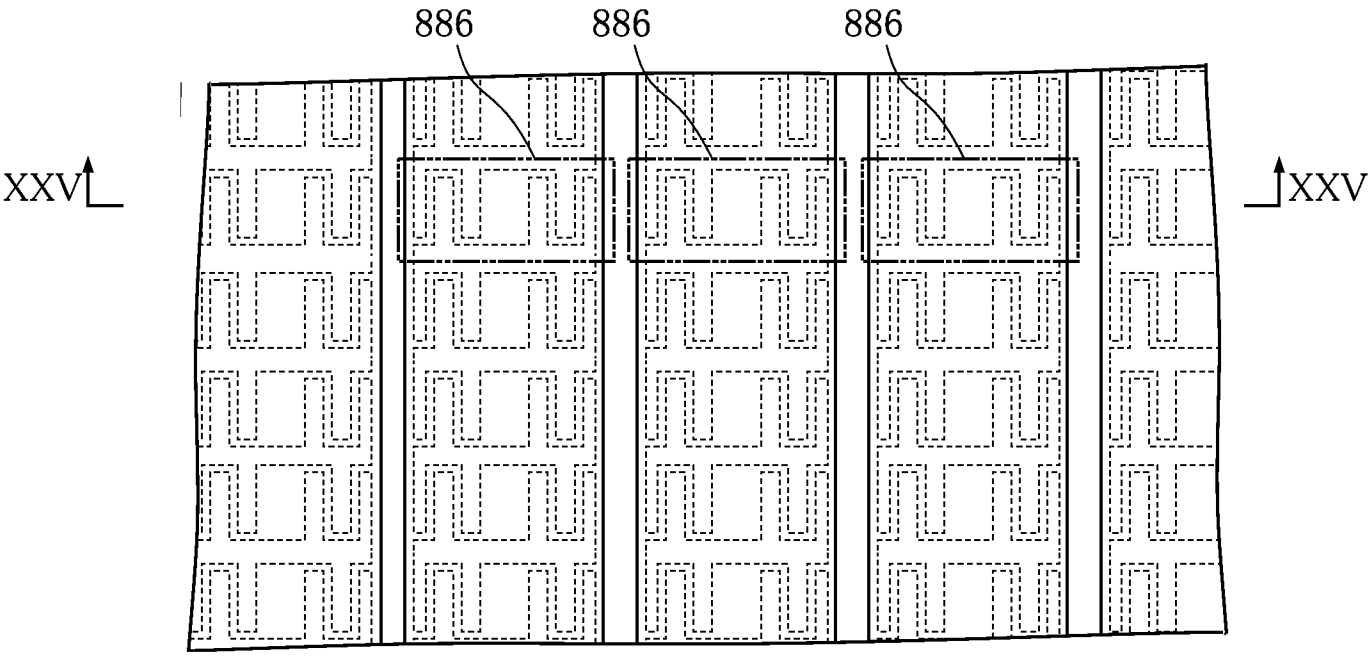
FIG. 24 is partially enlarged plan view showing a step subsequent to FIG. 22.
Figure 25:
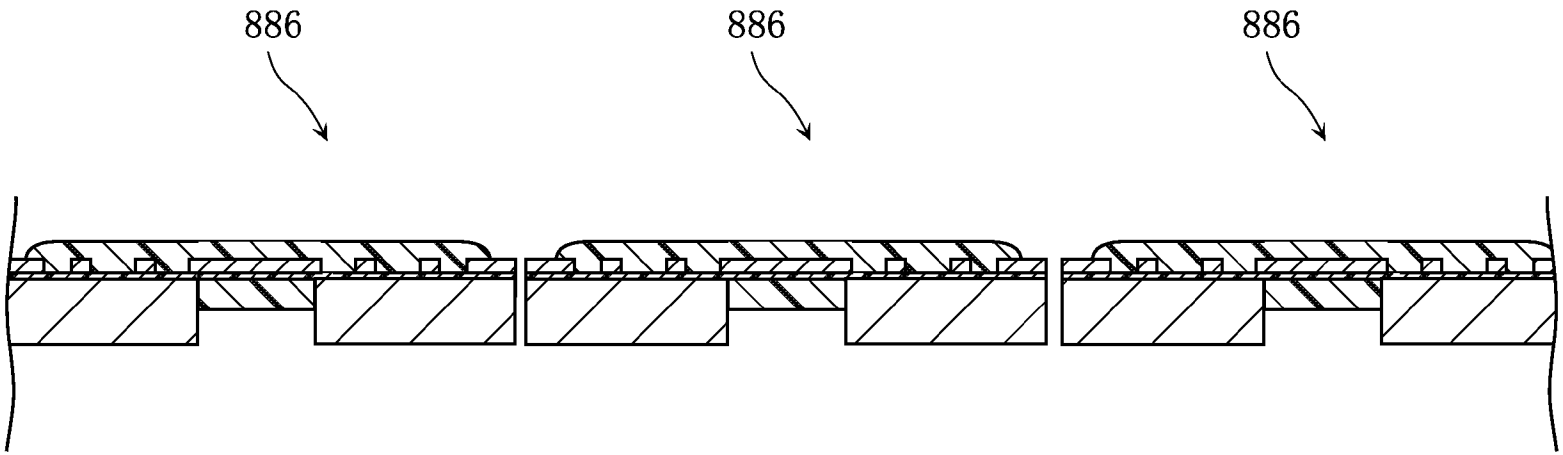
FIG. 25 is a sectional view taken along lines XXV-XXV in FIG. 24.

Then, as shown in FIGS. 24 and 25, a plurality of individual pieces 886 are obtained from the intermediate product shown in FIG. 23. Specifically, the individual pieces 886 are obtained by cutting the base 810. In FIG. 24, the portions to become the individual pieces 886 are indicated by double-dashed lines. In the step to obtain the individual pieces 886, the base 810 is cut by punching or dicing. By cutting the base 810, the first-electrode outer side surface 113, first-electrode end surface 115 and first-electrode end surface 116 of the first electrode 11, the second-electrode outer side surface 123, second-electrode end surface 125 and second-electrode end surface 126 of the second electrode 12, and the first resistor-element side surface 223, first resistor-element end surface 225, first resistor-element end surface 226, second resistor-element side surface 233, second resistor-element end surface 235 and second resistor-element end surface 236 of the resistor element 2 are formed.

When punching is used to produce the individual pieces 886, force is applied to the base 810 and the resistor element material 820 by the punching die (not shown). Thus, the shape of the first electrode 11 or the second electrode 12 may not become a complete rectangular parallelepiped. For instance, the sharp portion 119 and the first curved surface 118 may be formed at the first electrode 11 as shown in FIG. 12 or the sharp portions 129 and the second curved surface 128 may be formed at the second electrode 12 as shown in FIG. 13.

Since the base 810 and the resistor element material 820 are cut at the same time, the first-electrode outer side surface 113 and the first resistor-element side surface 223 become flush with each other, as noted above. Since the base 810 and the resistor element material 820 are cut at the same time, the second-electrode outer side surface 123 and the second resistor-element side surface 233 become flush with each other, as noted above. Since the base 810 and the resistor element material 820 are cut at the same time, the first-electrode end surface 115, the first resistor-element end surface 225, the second-electrode end surface 125, the second resistor-element end surface 235 become flush with each other, as noted above. Since the base 810 and the resistor element material 820 are cut at the same time, the first-electrode end surface 116, the first resistor-element end surface 226, the second-electrode end surface 126 and the second resistor-element end surface 236 become flush with each other, as noted above.

Then, the first plating layer 4 (first inner plating film 41, first intermediate plating film 42 and first outer plating film 43) and the second plating layer 5 (second inner plating film 51, second intermediate plating film 52 and second outer plating film 53) shown in e.g. FIG. 2 are formed on each individual piece 886. For instance, the first plating layer 4 and the second plating layer 5 may be formed by electroplating. For instance, the first plating layer 4 and the second plating layer 5 may be formed by barrel plating. By performing the above-described steps, the chip resistor 100 is completed.

The advantages of the above-noted arrangements are described below.

As noted above, the chip resistor 100 includes the first electrode 11, the second electrode 12, the resistor element 2 and the bonding layer 3. The resistor element 2 is arranged on the first electrode 11 and the second electrode 12. The bonding layer 3 is provided between the first electrode 11 and the resistor element 2 and between the second electrode 12 and the resistor element 2. According to this arrangement, the strength of the chip resistor 100 as a whole is maintained appropriately by the first electrode 11 and the second electrode 12 even when the thickness of the resistor element 2 is reduced. Thus, it is possible to increase the resistance of the resistor element 2 (resistance of the chip resistor 100) while keeping the strength of the chip resistor 100. That is, the chip resistor 100 can be structured as a high power resistor. The resistance of the chip resistor 100 is not lower than 10 mΩ.

According to the illustrated embodiment, the first-electrode outer side surface 113 is flush with the first resistor-element side surface 223. Thus, unlike the arrangement in which the first resistor-element side surface 223 is offset from the first-electrode outer side surface 113 in the second direction X2, the first electrode 11 can be provided without the need for forming an electrode to connect the first electrode 11 and the resistor element 2 to each other in addition to the plating layer 4. This enhances the manufacturing efficiency of the chip resistor 100.

Likewise, the second-electrode outer side surface 123 is flush with the second resistor-element side surface 233. Thus, unlike the arrangement in which the second resistor-element side surface 233 is offset from the second-electrode outer side surface 123 in the first direction X1, the second electrode 12 can be provided without the need for forming an electrode to electrically connect the second electrode 12 and the resistor element 2 to each other in addition to the plating layer 4. This enhances the manufacturing efficiency of the chip resistor 100.

The present invention is not limited to the foregoing embodiment. The specific structure of each part of the present invention may be varied in many ways.

In the method described above, the grooves 816 are formed in the base 810 before the resistor element material 820 is bonded to the base 810. However, the method for making the chip resistor 100 is not limited to this. For instance, the grooves 816 may be formed in the base 810 after the protective film 860 is formed.

The invention claimed is:

1. A resistor comprising:

a first electrode including an obverse surface and a reverse surface that face opposite sides to each other;

a second electrode spaced apart from the first electrode, the second electrode including an obverse surface and a reverse surface that face opposite sides to each other, the first electrode being offset from the second electrode in a first direction, and the second electrode being offset from the first electrode in a second direction opposite to the first direction;

a first electrical insulator located between the first electrode and the second electrode, the first electrical insulator including an obverse surface and a reverse surface that face opposite sides to each other;

a second electrical insulator including an obverse surface and a reverse surface that face opposite sides to each other, the reverse surface of the second electrical insulator facing each of the obverse surfaces of the first electrode, the second electrode, and the first electrical insulator, the second electrical insulator having heat conductivity, the second electrical insulator including a first side surface facing in the first direction side, and a second side surface facing in the second direction side;

a resistor element located on the obverse surface of the second electrical insulator;

a first electrical conductor electrically connected, at the obverse surface side of the second electrical insulator, to the resistor element; and a second electrical conductor electrically connected, at the obverse surface side of the second electrical insulator, to the resistor element, wherein a distance between the reverse surface of the second electrical insulator and the reverse surface of the first electrode is larger than a distance between the reverse surface of the second electrical insulator and the reverse surface of the first electrical insulator, a distance between the reverse surface of the second electrical insulator and the reverse surface of the second electrode is larger than the distance between the reverse surface of the second electrical insulator and the reverse surface of the first electrical insulator, the first electrode includes a first exposed surface that is exposed from the first electrical insulator and that is located at the reverse surface side of the second electrical insulator, the second electrode includes a second exposed surface that is exposed from the first electrical insulator and that is located at the reverse surface side of the second electrical insulator, the second exposed surface of the second electrode facing the first exposed surface of the first electrode, the first electrical conductor is located on the obverse surface of the second electrical insulator, the first side surface of the second electrical insulator, the reverse surface of the first electrode, and the first exposed surface of the first electrode, and the second electrical conductor is located on the obverse surface of the second electrical insulator, the second side surface of the second electrical insulator, the reverse surface of the second electrode, and the second exposed surface of the second electrode.

2. The resistor of claim 1, wherein each of the first electrical conductor and the second electrical conductor is held in contact with the first electrical insulator.

3. The resistor of claim 1, wherein each of the first electrical conductor and the second electrical conductor includes a portion located between the first exposed surface and the second exposed surface.

4. The resistor of claim 1, wherein the resistor element is held in contact with the obverse surface of the second electrical insulator.

5. The resistor of claim 1, wherein the first electrical conductor is held in contact with the reverse surface of the first electrode.

6. The resistor of claim 1, wherein the first electrode includes two first-electrode end surfaces facing opposite sides to each other, one of the two first-electrode end surfaces facing in a third direction, the third direction being perpendicular to the first direction and the second direction, and the first electrical conductor is located on the two first-electrode end surfaces.

7. The resistor of claim 1, wherein the first electrical conductor is held in contact with the first exposed surface.

8. The resistor of claim 1, wherein the resistor element comprises a serpentine portion.

9. The resistor of claim 1, wherein the first electrical conductor includes an inner plating film and an outer plating film, and the inner plating film is held in contact with the first electrode.

10. The resistor of claim 9, wherein the first electrical conductor includes an intermediate plating film located between the inner plating film and the outer plating film.

11. The resistor of claim 10, wherein the inner plating film is made of one of Cu, Ag and Au, the outer plating film is made of Sn, and the intermediate plating film is made of Ni.

12. The resistor of claim 1, wherein the second electrical insulator is made of an epoxy-based material.

13. The resistor of claim 1, wherein the resistor element is made of one of manganin, zeranin, Ni—Cr alloy, Cu—Ni alloy, and Fe—Cr alloy.

* * * * *